United States Patent [19]

Inoue et al.

[11] Patent Number: 4,914,002

[45] Date of Patent: Apr. 3, 1990

[54] SILVER HALIDE PHOTOGRAPHIC MATERIAL

[75] Inventors: Nobuaki Inoue; Hisashi Okada; Shigeo Hirano; Kimitaka Kameoka; Tetsuo Yoshida; Morio Yagihara, all of Kanagawa, Japan

[73] Assignee: Fuji Photo Film Co., Ltd., Kanagawa, Japan

[21] Appl. No.: 267,469

[22] Filed: Nov. 4, 1988

[30] Foreign Application Priority Data

Nov. 4, 1987 [JP] Japan ..... 62-278692
Dec. 4, 1987 [JP] Japan ..... 62-307184

[51] Int. Cl.[4] ..... G03C 1/06

[52] U.S. Cl. ..... 430/264; 430/214; 430/551; 430/583; 430/600; 430/603

[58] Field of Search ..... 430/583, 600, 603, 551, 430/214, 264

[56] References Cited

U.S. PATENT DOCUMENTS

| | | | |
|---|---|---|---|
| 4,385,108 | 5/1983 | Takagi et al. | 430/264 |
| 4,518,689 | 5/1985 | Noguchi et al. | 430/583 |
| 4,722,884 | 2/1988 | Inoue et al. | 430/264 |
| 4,761,362 | 8/1988 | Sasaoka et al. | 430/264 |

*Primary Examiner*—Paul R. Michl
*Assistant Examiner*—Thovl Chea
*Attorney, Agent, or Firm*—Sughrue, Mion, Zinn, Macpeak & Seas

[57] ABSTRACT

A silver halide negative photographic material comprising a support having thereon at least one silver halide emulsion layer, at least one hydrophilic colloidal layer thereof containing (1) a hydrazine derivative, (2) a compound substantially having no absorption maximum in the visible light region represented by formula (I):

(I)

wherein $Z^{11}$, $Z^{12}$, $R^{11}$, $R^{12}$ X and n are as defined in the specification, and (3) at least one compound represented by formula (II) or (III):

(II)

wherein $R_1$, $R_2$, $R_3$ and Q are as defined in the specification; and (III)

wherein $R_{21}$, $R_{22}$, $R_{23}$, and $R_{24}$, are as defined in the specification. The photographic material can be processed with a stable developer to provide an ultra-high contrast image without reduction in sensitivity, gamma or maximum density or the appearance of black pepper. The photographic material is excellent in pressure properties and anti-blocking properties.

20 Claims, No Drawings

SILVER HALIDE PHOTOGRAPHIC MATERIAL

FIELD OF THE INVENTION

This invention relates to a silver halide photographic material, and more particularly to a negative silver halide photographic material for use in the photographic plate making filed which can be developed rapidly with a highly stable processing solution to provide a high contrast image.

BACKGROUND OF THE INVENTION

It is known that a photographic image having ultra-high contrast can be formed by using a certain kind of silver halide, and such a technique is used in the field of photographic printing plate making.

For example, it is known to form a line image or a dot image having high contrast and high blackening density in which the image area and non-image area can be clearly distinguished, by developing a lith film containing a silver chlorobromide emulsion containing at least 50 mol % of silver chloride with a hydroquinone developer containing, as a preservative, a sulfite ion in a concentration controlled at an extremely low level, usually not more than 0.1 mol/l. Since a developer of this type is extremely susceptible to air oxidation due to the low sulfite concentration, various efforts have been made to stably maintain the developing activity.

In order to overcome the unstability in image formation according to the above-described lith development system, an image formation system is required in which a processing solution having satisfactory preservability is used to obtain ultra-high contrast. To this end, it has been proposed that a surface latent image type silver halide photographic material having incorporated therein a specific hydrazine derivative is processed with a developer having a pH of from 11.0 to 12.3 and containing 0.15 mol/l or more of a sulfite preservative (which exhibits satisfactory preservation stability) to thereby form a negative image of ultra-high contrast, having a gamma exceeding 10, as described in U.S. Pat. Nos. 4,166,742, 4,168,977, 4,221,857, 4,224,401, 4,243,739, 4,272,606, 4,311,781, 4,269,929, and 4,650,746. This new image formation system has a further advantage that not only silver chlorobromide but silver iodobromide and silver chloroiodobromide can be employed, while the conventional ultra-high contrast image formation systems are applicable only to silver chlorobromide having a high silver chloride content.

However, in the above system, if the pH of the developer is reduced or the bromide ion concentration of the developer increases as a result of processing of a large quantity of silver halide photographic materials, the photographic materials exhibit reduction of sensitivity, gamma or maximum density. Even when the volume of films to be processed is not large, if the concentration of the sulfite preservative is considerably reduced or the pH increases due to fatigue of the developer with time, an unfavorable phenomenon called black pepper frequently occurs. The term "black pepper" as used herein means black spots of fine developed silver appearing in non-image areas (unexposed areas). Although these disadvantages may be eliminated by increasing the amount of a replenisher for the developer, such a replenishment method involves an increase of cost of the developer, handling of waste liquid, and the like. A system is eagerly sought which does not cause reduction of maximum density or black pepper without increasing the amount of a replenisher.

Further, in the new image formation system, a sensitizing dye added with the aim of increasing sensitivity has remarkable influences upon gamma or black pepper appearance, as reported in JP-A-61-47943 and 62-25745 (the term "JP-A" as used herein means an "unexamined published Japanese patent application"). JP-A-61-29837 and Japanese patent application No. 61-79533 disclose sensitizing dyes which improve black pepper without causing reduction of gamma. These dyes, however, cause color remaining after development processing when used in an amount sufficient for achieving appreciable improvement in black pepper.

In the above-described system using a hydrazine derivative, development nuclei in areas exposed to even a trace amount of light can be amplified by the hydrazine derivative so that the areas exhibit high contrast. This means that fog nuclei due to electrons generated by externally applied pressure or subcenters of the latent image intensified by the electrons are also liable to be amplified. This disadvantage in practical use of photographic systems causes the unfavorable phenomenon that areas which should not be blackened are blackened due to linear fog by pressure application (pressure marks) or sensitization of the toe by pressure application. This phenomenon will hereinafter referred to as "pressure properties".

With respect to the ultra-high contrast negative image formation system, some of the compounds represented by formula (III) hereinafter described have been disclosed in JP-A-54-40629 (corresponding to U.S. Pat. No. 4,377,634), 56-1936 (corresponding to U.S. Pat. No. 4,385,108), 56-89738, 57-129433 (corresponding to U.S. Pat. No. 4,447,522), to 57-129436 (corresponding to U.S. Pat. No. 4,429,036), 61-233734, 62-21143, 62-63932, 62-296138 and 103232. Compounds represented by formula (II) hereinafter described have been disclosed in JP-A-61-29837, 62-237445, 62-280733 and 62-280734 and also proposed as antifoggant for silver halide color photographic materials in U.S. Pat. No. 4,147,547.

The above-cited JP-A-56-1936 discloses a system in which a light-sensitive material contains a hydroquinone and a large amount (0.05 mol/Ag or more) of the compound of formula (III). JP-A-62-21143 describes that unsubstituted hydroquinone and sulfo-substituted hydroquinone improve pressure properties but, in turn, deteriorate anti-blocking properties.

In conventional hard negative image formation systems using a hydrazine derivative, the compound represented by formula (I) has been used for various purposes described in JP-A-61-29837 and 62-280734 and Japanese patent application Nos. 61-80640 and 61-24830. Further, U.S. Pat. No. 4,147,547 refers to use of the compound of formula (I) as an antifoggant for color silver halide photographic materials. The compounds of formula (II) are described in U.S. Pat. Nos. 4,272,606 and 4,429,036.

None of the above-cited publications discloses or suggests that a combination of the compound of formula (III) and the compound of formula (I) would satisfy both demands for improving pressure properties and black pepper. Further, in order to make the best use of the improving effects of the compound of formula (III) on pressure properties, a technique to improve anti-adhesion properties is also required.

SUMMARY OF THE INVENTION

One object of this invention is to provide a highly sensitive silver halide photographic material which can be processed with a stable developer to provide a high contrast image as having a gamma exceeding 10.

Another object of this invention is to provide a silver halide photographic material free from reduction in sensitivity, gamma and maximum density even when the pH of a developer is reduced or a bromine ion concentration of a developer increases as a result of processing of a large volume of films.

A further object of this invention is to provide a silver halide photographic material which is free from black pepper and excellent in pressure properties and anti-adhesion properties even when the sulfite concentration of a developer is considerably reduced or the pH of a developer increases due to fatigue of the developer with time.

A still further object of this invention is to provide a silver halide photographic material free from discoloration.

It has now been found that these and other objects of this invention can be accomplished by a silver halide negative photographic material composed of a support having thereon at least one silver halide emulsion layer, at least one hydrophilic colloidal layer thereof containing (1) a hydrazine derivative, (2) a compound having no substantial absorption maximum in the visible light region represented by formula (I):

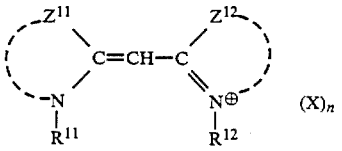

(I)

wherein $Z^{11}$ and $Z^{12}$, which may be the same or different, each represents a non-metallic atomic group necessary for forming a substituted or unsubstituted heterocyclic ring selected from benzoxazole, benzothiazole, benzoselenazole, naphthoxazole, naphthothiazole, naphthoselenazole, thiazole, thiazoline, oxazole, selenazole, selenazoline, pyridine, benzimidazole and quinoline; $R^{11}$ and $R^{12}$, which may be the same or different each represents a substituted or unsubstituted alkyl group or a substituted or unsubstituted aralkyl group, provided that at least one of $R^{11}$ and $R^{12}$ is substituted with at least one acid group; X represents a counter ion necessary for change balance; and n is 0 or 1; and (3) at least one compound represented by formula (II) or (III):

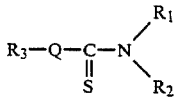

(II)

wherein $R_1$ and $R_2$, which may be the same or different, each represents hydrogen, a substituted or unsubstituted alkyl group, a substituted or unsubstituted aryl group, a substituted or unsubstituted heterocyclic group or an amino group; $R_3$ represents hydrogen, a substituted or unsubstituted alkyl group, a substituted or unsubstituted aryl group or a substituted or unsubstituted heterocyclic group; and Q represents a single bond or a divalent group selected from sulfur selenium, oxygen, a disulfide group (—S—S—),

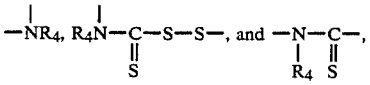

wherein $R_4$ has the same meaning as $R_3$; provided that $R_1$ and $R_2$, $R_1$ and $R_3$, or $R_3$ and $R_4$ may be linked to form a substituted or unsubstituted 5-membered or 6-membered heterocyclic ring; further provided at least one of $R_2$ and $R_4$ represents a group other than hydrogen when $R_1$ and $R_3$ are linked to form a heterocyclic ring and the heterocyclic ring formed by $R_1$ and $R_3$ is a ring other than a rhodanine ring: and

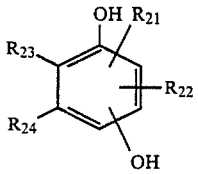

(III)

wherein $R_{21}$, $R_{22}$, $R_{23}$, and $R_{24}$, which mkay be the saem or different, each represents hydrogen, a hydroxyl group, an alkoxy group, an aryloxy group, an alkylthio group, an arylthio group, a halogen atom, a primary amino group, a secondary amino group, a tertiary amino group, a carbonamido group, a sulfonamido group, an alkyl group, an aryl group, a 5-membered or 6-membered heterocyclic group containing at least one hetero atom selected from nitrogen, oxygen and sulfur, a formyl group, a keto group, a sulfo group, a carboxyl group, an alkylsulfonyl group or an arylsulfonyl group, provided that at least one of $R_{21}$, $R_{22}$, $R_{23}$, and $R_{24}$ represents group other than hydrogen when the compound represented by formula (III) is 1,4-dihydroxybenzene.

The invention also relates to a method for forming an image by imagewise exposing the above-described light-sensitive material to light and developing the exposed material with a developer containing at least than 0.15 mol/l of a sulfite ion and having a pH between 10.5 and 12.3.

DETAILED DESCRIPTION OF THE INVENTION

In formula (I), the heterocyclic ring formed by $Z_{11}$ and $Z_{12}$ is preferably a benzoxazole, benzothiazole, naphthoxazole, naphthothiazole, thiazole, or oxazole ring, more preferably a benzoxazole, benzothiazole or naphthoxazole ring, and most preferably a benzoxazole or naphthoxazole ring.

Substituent for the heterocyclic ring formed by $Z_{11}$ or $Z_{12}$ include a halogen atom (e.g., fluorine, chlorine, bromide, iodine), a nitro group, an alkyl group preferably having up to 4 carbon atoms (e.g., methyl, ethyl trifluoromethyl, benzyl, phenethyl), an aryl group (e.g., phenyl), an alkoxy group preferably having up to 4 carbon atoms (e.g., methoxy, ethoxy, propoxy, butoxy), a carboxyl group, an alkoxycarbonyl group preferably having from 2 to 5 carbon atoms (e.g., ethoxycarbonyl), a hydroxyl group and a cyano group, and so on.

Specific examples of the benzoxazole nucleus are benzoxazole, 5-chlorobenzoxazole, 5-methylbenzoxazole, 5-bromobenzoxazole, 5-flurobenzoxazole, 5-phenylbenzoxazole, 5-methoxybenzoxazole, 5-ethoxybenzoxazole, 5-trifluorormethylrbenzoxazole, 5-hydroxybenzoxazole, 5-carboxybenzoxazole, 6-methylbenzoxazole, 6-chlorobenzoxazole, 6-methoxybenzoxazole, 6-hydroxybenzoxazole, and 5,6-dimethylbenzoxazole. Specific examples of the benzothiazole nuclues are benzothiazole, 4-chlorobenzothiazole, 5-nitrobenzothiazole, 5-methylbenzothiazole, 6-bromobenzothiazole, 5-iodobenzothiazole, 5-phenylbenzothiazole, 5-methoxybenzothiazole, 6-methoxybenzothiazole, 5-carboxybenzothiazole, 5-ethoxycarbonylbenzothiazole, 5-fluorobenzothiazole, 5-chloro-6-methylbenzorthiazole, and 5-trifluoromethylbenzothiazole. Specific examples of the benzoselenazole nucleus are benzoselenazole, 5-chlorobenzoselenazole, 5-methoxybenzoselenazole, 5-hydroxybenzoselenazole, and 5-chloro-6-methylbenzoselenazole. Specific examples of the naphthoxazole nucleus are naphtho[2,1-d]oxazole, naphtho[1,2-d]oxazole, naphtho[2,3-d]oxazole, and 5-methoxynaphtho[1,2-d]oxazole, naptho[2,3-d]oxazole, and 5-methoxynaptho[1,2-d]oxazole. Specific examples of the naphthothiazole nucleus are naphtho[2,1-d]thiazole and naphtho[1,2-d]thiazole naphtho[2,3-d]thioazole, 5-methoxynaphtho[1,2-d]thiazole, 5-methoxynaphtho[2,3-d]thiazole. Specific examples of the naphthoselenazole nucleus are naphtho[1,2-d]selenazole and naphtho[2,1-d]selenazole. Specific examples of the thiazole nucleus are thiazole, 4-methylthiazole, 4-phenylthiazole, and 4,5-dimethylthiazole. Specific examples of the thiazoline nucleus are thiazoline and 4-methylthiazoline. Specific examples of the oxazole nucleus are oxazole, 4-methyloxazole, 4-phenyloxazole, 4-methoxyoxazole, 4,5-dimethyloxazole, 5-phenyloxazole, and 4-methoxyoxazole. Specific examples of the pyridine nucleus are 2-pyridine, 4-pyridine, 5-methyl-2-pyridine, and 3-methyl-4-pyridine. Specific examples of the benzimidazole nucleus are 5,6-dichloro-1-ethylbenzimidazole and 6-chloro-1-ethyl-5-trifluoromethylbenzimidazole. Specific examples of the quinoline nucleus are 2-quinoline, 4-quinoline, 3-methyl-2-quinoline, 5-ethyl-2-quinoline, 8-fluoro-2-quinoline, 6-methoxy-2-quinoline, 8-chloro-4-quinoline, and 8-methyl-4-quinoline.

In formula (I), $R_{11}$ and $R_{12}$ each represents a substituted or unsubstituted alkyl group, and at least one of them contains at least one acid radical, such as a sulfo group and carboxyl group, with a sulfo group being preferred.

The unsubstituted alkyl group preferably contains 18 or less, more preferably 8 or less, carbon atoms, and includes methyl, ethyl, n-propyl, n-butyl, n-hexyl, and n-octadecyl groups. The substituted alkyl group preferably contains 6 or less, more preferably 4 or less, carbon atoms in its alkyl moiety, and includes an alkyl group substituted with a sulfo group bonded either directly or via an alkoxy group or an aryl group (e.g., 2-sulfoethyl, 3-sulfopropyl, 3-sulfobutyl, 4-sulfobutyl, 2-(3-sulfopropoxy)ethyl, 2-[2-(3-sulfopropoxy)ethoxy]ethyl, 2-hydroxy-3-sulfopropyl, p-sulfophenethyl, p-sulfophenylpropyl); an alkyl group substituted with a carboxyl group bonded either directly or via an alkoxy group or an aryl group (e.g., carboxymethyl, 2-carboxyethyl, 3-carboxypropyl, 4-carboxybutyl), a hydroxyalkyl group (e.g., 2-hydroxyethyl, 3-hydroxypropyl), an acyloxyalkyl group (e.g., 2-acetoxyethyl, 3-acetoxypropyl), an alkoxyalkyl group (e.g., 2-methoxyethyl, 3-methoxypropyl); an alkoxycarbonylalkyl group (e.g., 2-methoxycarbonylethyl, 3-methoxycarbonylpropyl, 4-ethoxycarbonylbutyl); a vinylsubstituted alkyl group (e.g., allyl); a cyano-alkyl group (e.g., 2-cyanoethyl); a carbamoylalkyl group (e.g., 2-carbamoylethyl); an aryloxyalkyl group (e.g., 2-phenoxyethyl, 3-phenoxypropyl); and an aralkyl group (e.g., 2-phenethyl, 3-phenylpropyl).

The counter ion X is an arbitrary anion capable of offsetting the positive charge of the quaternary ammonium salt in the heterocyclic ring and includes, for example, a bromine ion, a chlorine ion, an iodine ion, a p-toluenesulfonate ion, an ethylsulfonate ion, a perchlorate ion, a trifuloromethanesulfonate ion, and a thiocyanate ion. In this case, n in formula (I) is 1.

In cases where either one of $R_{11}$ and $R_{12}$ contains an anionic substituent as in a sulfoalkyl group, the compound can take the form of a betaine. In these cases, n in formula (I) represents 0. In cases where $R_{11}$ and $R_{12}$ both contain such an anionic substituent, the counter ion X is a cation, such as an alkali metal ion (e.g., sodium ion, potassium ion) and an ammonium salt ion (e.g., triethylammonium).

The term "a compound substantially having no absorption maximum in the visible light region" as used herein means a compound which causes no practical problem of color remaining in non-image areas of the light-sensitive material after development processing. Such a compound preferably has an absorption maximum in methanol at 460 nm or less, more preferably at 430 nm or less.

Of compounds represented by formula (I), compound having $R_{11}$ and $R_{12}$ both of which are substituted with a sulfo group is most preferable.

Specific examples of the compound represented by formula (I) are shown below, but the present invention is not to be construed as being limited thereto.

I-1

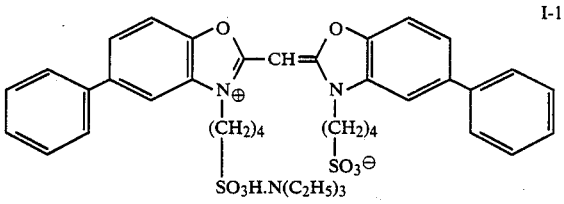

I-2

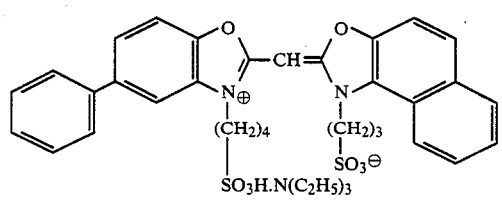

I-3

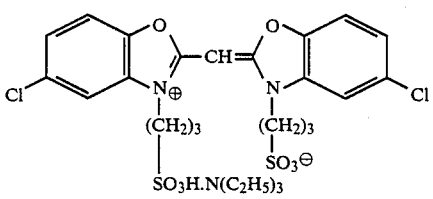

-continued
I-4
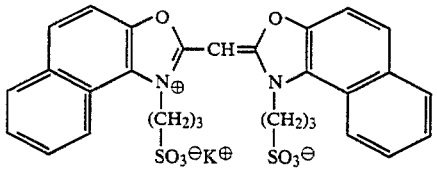
I-5
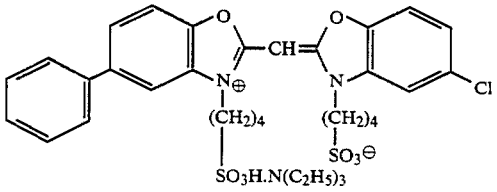
I-6
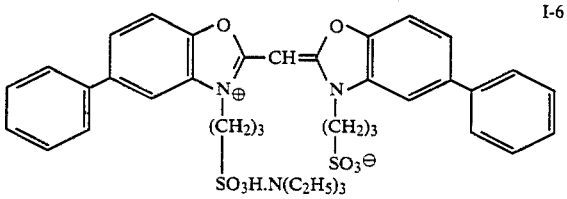
I-7
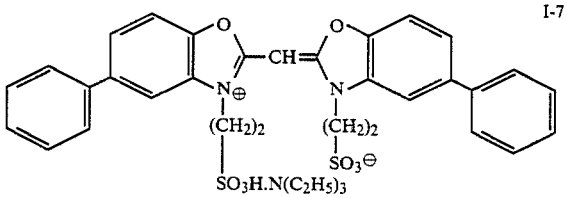
I-8
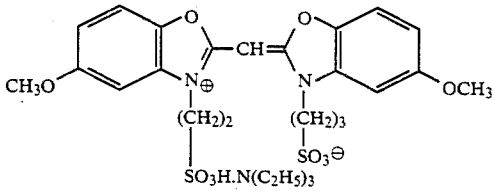
I-9
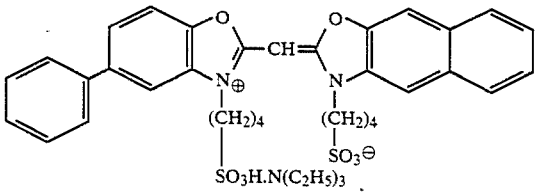
I-10
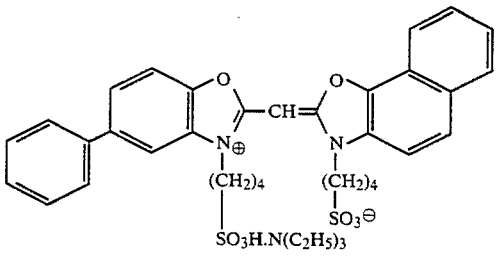
-continued
I-11
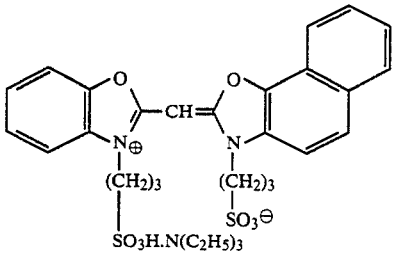
I-12
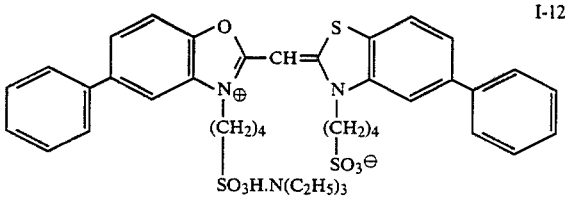
I-13
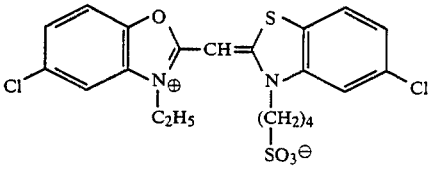
I-14
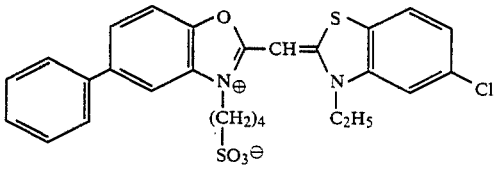
I-15
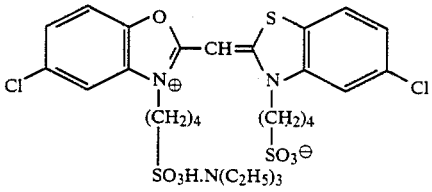
I-16
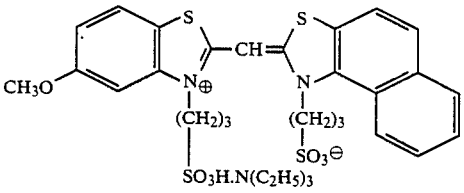
I-17
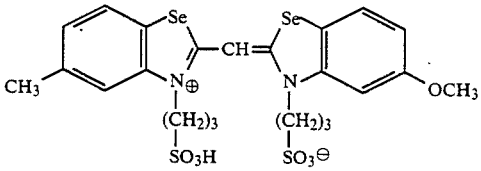
I-18
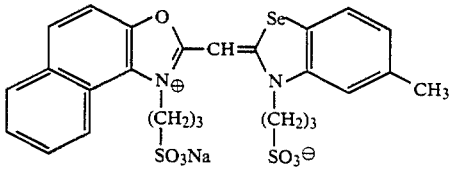

-continued

I-19

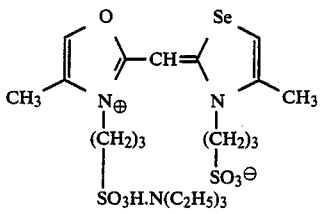

I-20

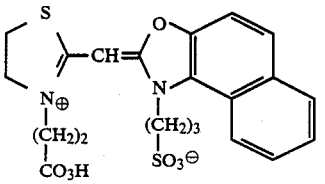

I-21

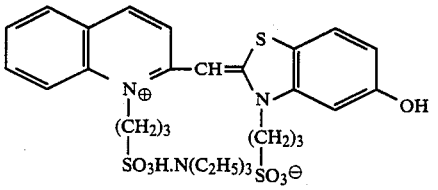

I-22

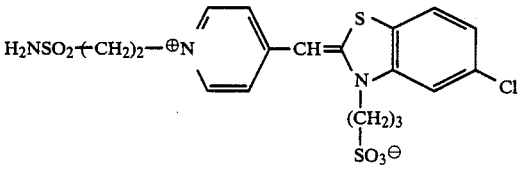

I-23

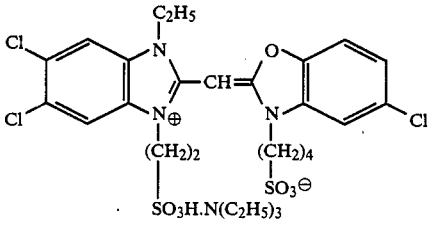

I-24

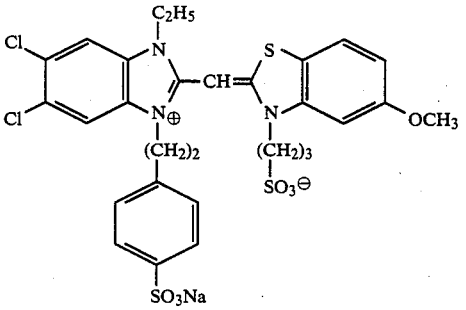

I-25

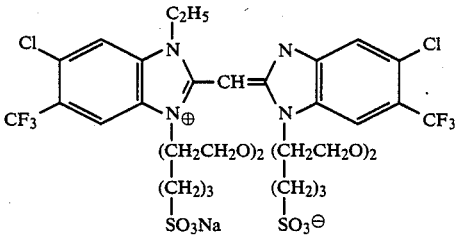

-continued

I-26

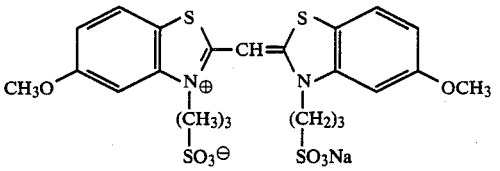

In formula (II), the alkyl group represented by $R_1$, $R_2$, $R_3$, and $R_4$ contains from 1 to 20 carbon atoms. Substituents for the alkyl group include a halogen atom (e.g., chlorine), a cyano group, a carboxyl group, a hydroxyl group, an acyloxy group having from 2 to 6 carbon atoms (e.g., acetoxy), an alkoxycarbonyl group having from 2 to 22 carbon atoms (e.g., ethoxycarbonyl, butoxycarbonyl), a substituted or unsubstituted monocyclic or bicyclic aryl group (e.g., phenyl, tolyl, p-sulfophenyl). Examples of preferred alkyl groups are methyl, ethyl, n- or iso-propyl, n-, iso- or t-butyl, n- or isoamyl, n- or isohexyl, n- or isooctyl, n- or isododecyl, n- or isopentadecyl, n- or isoheptadecyl, chloromethyl, 2-chloromethyl, 2-cyanoethyl, carboxymethyl, 2-carboxyethyl, 2-hydroxyethyl, 2-acetoxyethyl, acetoxyethyl, acetoxymethyl, ethoxycarbonylmethyl, butoxycarbonylmethyl, 2-methoxycarbonylethyl, benzyl, o-nitrobenzyl, and p-sulfobenzyl groups.

The aryl group represented by $R_1$, $R_2$, $R_3$, and $R_4$ is a substituted or unsubstituted, monocyclic or bicyclic aryl group, preferably a monocyclic group. Substituents therefor include an alkyl group having up to 20 carbon atoms (e.g., methyl, ethyl, nonyl), an alkoxy group having up to 20 carbon atoms (e.g., methoxy, ethoxy), a hydroxyl group, a halogen atom (e.g., chlorine, bromine), a carboxyl group, or a sulfo group. Specific examples of the aryl group are phenyl, p-tolyl, p-methoxyphenyl, p-hydroxyphenyl, p-chlorophenyl, 2,5-dichlorophenyl, p-carboxyphenyl, o-carboxyphenyl, 4-sulfophenyl, 2,4-disulfophenyl, 2,5-disulfophenyl, 3-sulfophenyl, and 3,5-disulfophenyl groups.

The heterocyclic group represented $R_1$, $R_2$, $R_3$ and $R_4$ preferably includes 5-membered to 7-membered heterocyclic rings, e.g., pyrrolidine, pyrrole, tetrahydrofuran, furan, tetrahydrothiophene, thiophene, thiazole, thiadiazoline, oxazole, oxazoline, imidazole, imidazoline, triazole, terazole, thiadiazole, oxadiazole, benzothiazole, benzoxazole, benzimidazole, morpholine, pyridine, quinoline, quinoxaline, azepine, etc. These heterocyclic groups may be substituted by the substituents for the alkyl group and the aryl group enumerated for $R_1$, $R_2$, and $R_3$.

The 5- or 6-membered heterocyclic ring formed by $R_1$ and $R_2$, or $R_3$ and $R_4$ includes piperidine, pierazine, morpholine, pyrrole, pyrazole, imidazole and triazole rings, with piperidine, pyrrole, piperazine and morpholine rings being particularly preferred.

The 5- or 6-membered heterocyclic ring formed by $R_1$ and $R_3$ includes thiazoline, thiazolidene, selenazoline, oxazoline, oxazolidine, imidazoline, imidazolidine, pyrazoline, pyrazolidine, 1,3,4-thiadiazoline, 1,3,4-oxadiazoline, 1,3,4-triazoline, tetrazoline, thiohydrantoin, dihydropyridine, dihydropyrimidine, and dihydrotriazine rings. These heterocyclic rings include those to which a 5-membered to 7-membered carbon ring or hetero ring is condensed. Such condensed rings include thiazole condensed rings, e.g., benzothiazoline, naphthothiazoline, dihydronaphthothiazoline, tetrahydrobenzothiazoline; selenazole condensed rings, e.g., benzoselenazoline; oxazoline condensed rings, e.g., benzoxazoline, naphthoxazoline; imidazoline condensed rings, e.g., benzimidazoline, dihydroimidazolopyrimidine; triazoline condensed rings, e.g., dihydrotriazolopyridine, dihydrotriazolopyrimidine; pyrazoline condensed rings, e.g., dihydropyrazolopyridine, dihydropyrazolopyrimidine; and dihydropyrimidine condensed rings, e.g., dihydropyrazolopyrimidine, dihydropyrrolopyrimidine, dihydrotriazolopyrimidine.

These heterocyclic nuclei may have various substituents. The substituents include an alkyl group having up to 20 carbon atoms (e.g., methyl, ethyl, n-butyl, t-butyl, heptyl, heptadecyl), an alkoxy group having up to 20 carbon atoms (e.g., methoxy ethoxy, dodecyloxy, heptadecyloxy), an alkylthio group having up to 20 carbon atoms (e.g., methylthio, ethylthio, butylthio), a hydroxyl graoup, a mercapto group, an unsubstituted amino group, an alkyl-substituted amino group (e.g., dimethylamino, methylamino, diethylamino, butylamino, benzylamino), an aryl-substituted amino group (e.g., anilino, diphenylamino), an acylamino group (e.g., acetylamino, capryloylamino, benzoylamino, methylsulfonylamino, benzylsulfonylamino, p-toluenesulfonylamino), a thioamido group (e.g., acetylthioamido, propionylthioamide), an aryl group (e.g., phenyl, naphthyl, tolyl), an alkenyl group having from 2 to 20 carbon atoms (e.g., allyl, methallyl), an aralkyl group having up to 4 carbon atoms in the alkyl moiety thereof (e.g., benzyl, phenethyl), halogen atom (e.g., chlorine, bromide), a cyano group, a carboxyl group, a sulfo group, a carbamoyl group, a substituted carbamoyl group (e.g., methylcarbamoyl, dimethylcarbamoyl, ethylcarbamoyl, phenylcarbamoyl), a thiocarbamoyl group, a substituted thiocarbamoyl group (e.g., methylthiocarbamoyl, dimethylthiocarbamoyl, ethylthiocarbamoyl, phenylthiocarbamoyl), an alkoxycarbonyl group having from 2 to 22 carbon atoms (e.g., methoxycarbonyl, ethoxycarbonyl, butoxycarbonyl), an aryloxycarbonyl group (e.g., phenoxycarbonyl), an alkylcarbonyl group having from 2 to 22 carbon atoms (e.g., acetyl, capryloyl), or an oxygen atom. The alkyl group may further be substituted with a carboxyl group, a sulfo group, an alkoxycarbonyl group (e.g., methoxycarbonyl, ethoxycarbonyl), an acyloxy group (e.g., acetoxy), or an aryl group (e.g., phenyl nitrophenyl).

The above-described heterocylic rings may furthermore have a substituent selected from those enumerated from $R_2$ on the displacable nitrogen atom thereof.

In formula (II), when Q represents $$-\overset{|}{N}R_4,$$

the alkyl group represented by R4 contains up to 20 carbon atoms and includes substituted or unsubstituted alkyl groups. Substituents therefor include a halogen atom, a cyano group, a carboxyl group, a sulfo group, a sulfate group, a phospho group, a carbamoyl group, an aminosulfonyl group, a hydroxyl group, an alkoxy group having up to 20 carbon atoms (e.g., methoxy, ethoxy, propoxy, butoxy), a substituted alkoxy group having up to 20 carbon atoms [wherein the substituent includes a hydroxyl group, an alkoxy group having up to 6 carbon atoms (e.g., methoxy, ethoxy, propoxy), an acyloxy group having from 2 to 8 carbon atoms (e.g., acetoxy, propionoxy), a sulfo group and a sulfoalkoxy group having up to 6 carbon atoms (e.g., 2-sulfoethoxy, 3-sulfopropoxy)], an acyloxy group having from 2 to 22 carbon atoms (e.g., acetoxy, propionoxy), an alkenyl group having from 2 to 22 carbon atoms (e.g., vinyl), an alkoxycarbonyl group having from 2 to 22 carbon atoms (e.g., methoxycarbonyl, ethoxycarbonyl, butoxycarbonyl, dodecyloxycarbonyl), a monocyclic or bicyclic aryl group (e.g., phenyl), a substituted monocyclic or bicyclic aryl group (e.g., p-sulfophenyl), a heterocyclic group (e.g., thiazole, oxazole, imidazole, thiadiazole, oxadiazole, triazole, tetrazole and pyrimidine rings, with a ring of formula

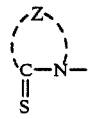

being particularly advantageous).

Of the compounds represented by formula (II), preferred compounds are represented by formula (II*a*);

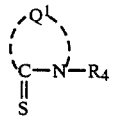

(IIa)

wherein $R_4$ is as defined above, but $R_4$ represents a group other than hydrogen; and $Q^1$ represents an atomic group necessary for forming a 5-membered or 6-membered heterocyclic ring, provided that the atom in the atomic group which is adjacent to the thioketo group is not bonded to a hydrogen atom.

Specific examples of the heterocyclic ring completed by $Q^1$ are the same as those enumerated for the heterocyclic ring formed by $R_1$ and $R_3$.

The heterocyclic ring completed by $Q^1$ may contain a divalent substituent, such as an oxo group (=0), a thioxo group (=S), an ethylidene group ($CH_3CH$=), a substituted ethylidene group (e.g., benzoxazolylideneethylidene, thiazolinylideneethylidene, pyridylideneethylidene, quinolylideneethylidene), a divalent residue of a heterocyclic ring (e.g., benzoxazolylidene, benzothiazolylidene, thiazolinylidene, pyridylidene, and quinolylidene).

The compounds of formula (II) can be synthesized by known processes as described, e.g., in JP-B-48-34169 (Compound Nos. 1 to 8, 31 and 32) (the term JP-B as used herein means an "examained published Japanese patent application"), *Yakugaku Zasshi*, Vol. 74, 1365–1369 (Compound No. 9) (1954), *Beilstain XIII*, 394, IV 121 (Compound Nos. 12 and 13), JP-B-47-18008 (Compound No. 19), and JP-B-48-34168 (Compound No. 25).

Specific examples of the compounds of formula (II) are shown below, but the present invention is not to be construed as being limited thereto

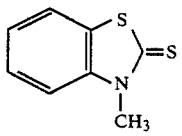

II-1

-continued
II-2
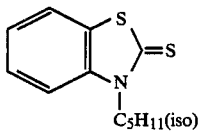
II-3
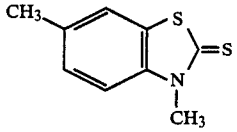
II-4
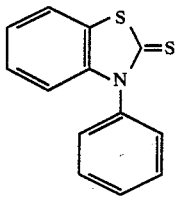
II-5
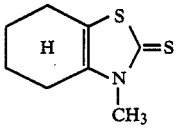
II-6
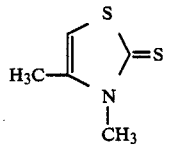
II-7
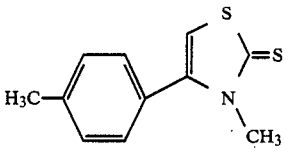
II-8
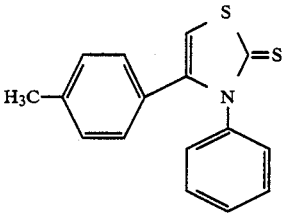
II-9
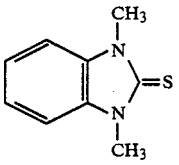
II-10
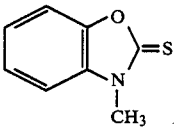
-continued
II-11
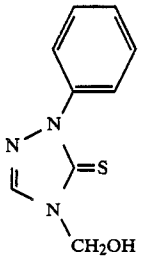
II-12
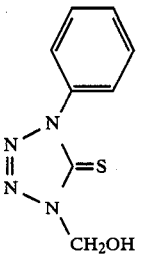
II-13
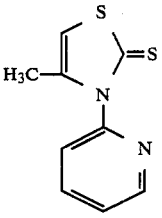
II-14
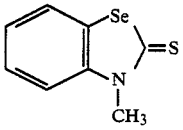
II-15
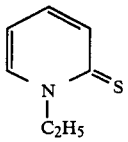
II-16
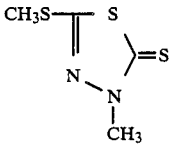
II-17
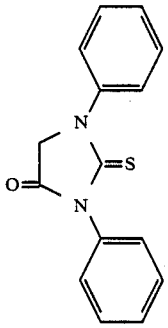

-continued

II-18

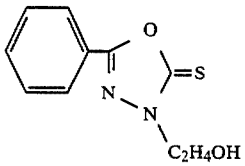

II-19

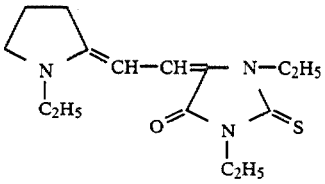

II-20

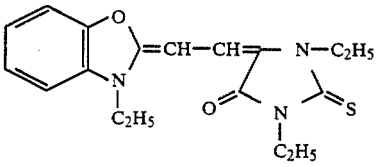

II-21

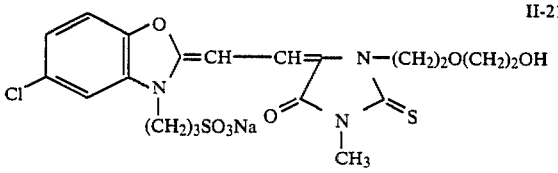

II-22

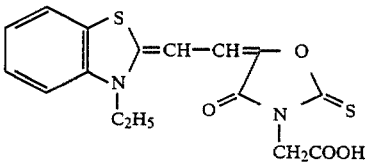

II-23

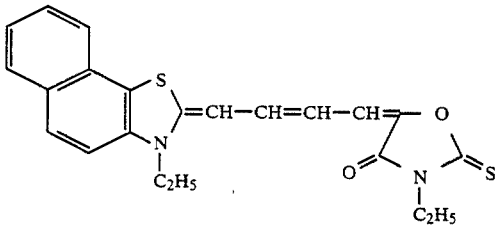

II-24

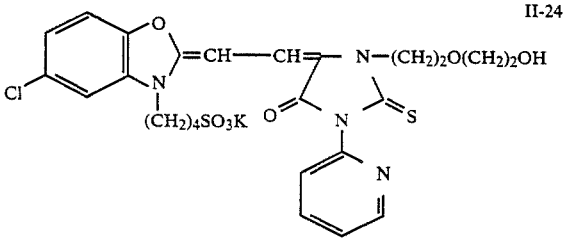

II-25

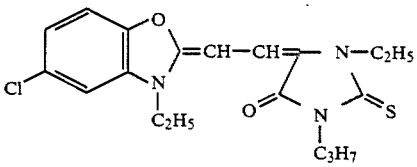

-continued

II-26

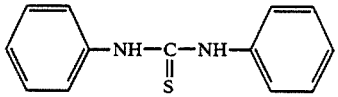

II-27

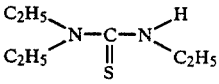

II-28

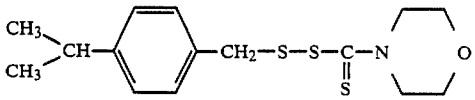

II-29

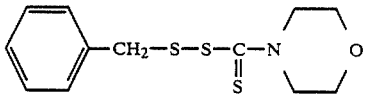

II-30

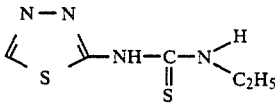

II-31

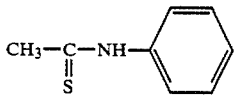

II-32

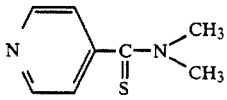

II-33

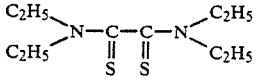

II-34

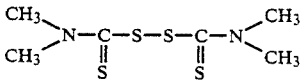

The dihydroxybenzene derivatives represented by formula (III) are described with a number of specific examples thereof, e.g., in *The Merck Index*, 10th Ed. as well as in U.S. Pat. Nos. 2,728,659, 3,700,453, and 3,227,552, JP-A-106329, 50-156438, 56-109344, 57-22237, 59-202465, and 58-17431, JP-B-50-21249, 56-40818, and 59-37497, British Pat. Nos. 752,146 and 1,086,208, West German Publication No. 2,149,789, *Chemical Abstracts*, Vol. 5, 6367h, and JP-A-57-17949.

Specific examples of these dihydroxybenzene derivatives are shown below, but the present invention is not to be construed as being limited thereto.

III-1

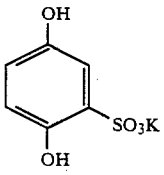

-continued
III-2
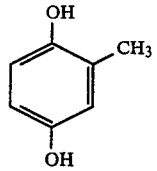
III-3
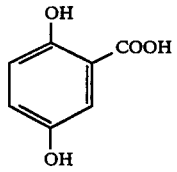
III-4
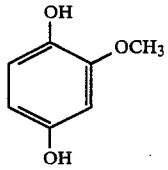
III-5
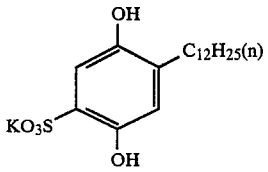
III-6
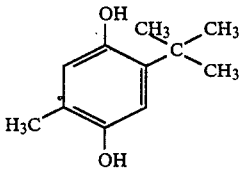
III-7
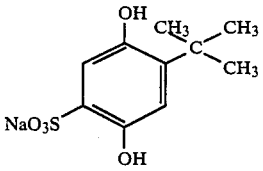
III-8
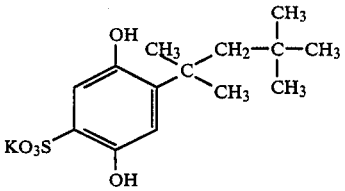
III-9
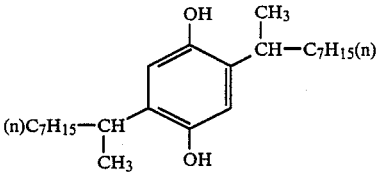
III-10
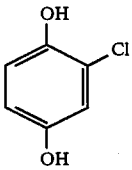
-continued
III-11
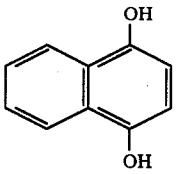
III-12
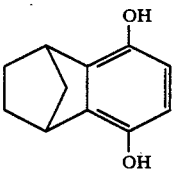
III-13
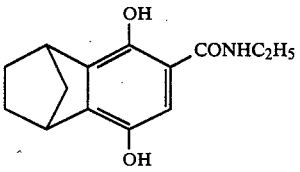
III-14
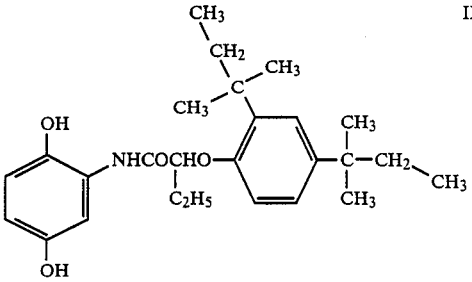
III-15
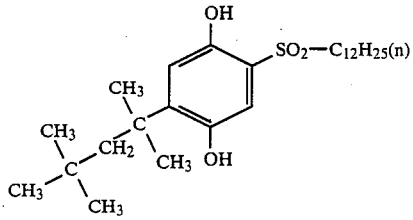
III-16
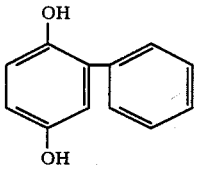
III-17
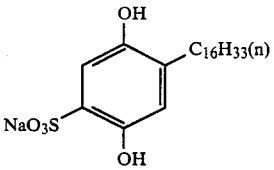
III-18
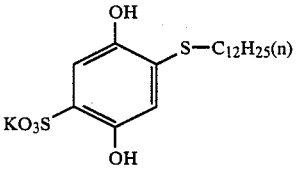

-continued
III-19
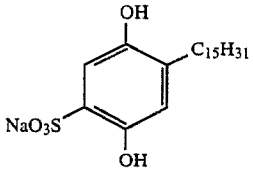
III-20
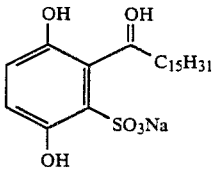
III-21
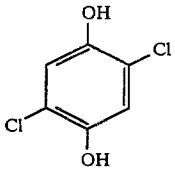
III-22
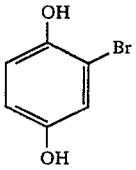
III-23
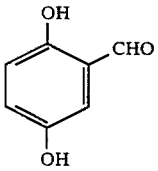
III-24
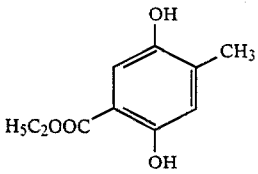
III-25
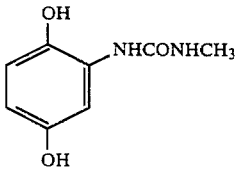
III-26
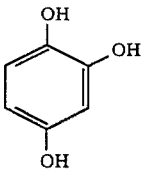
III-27
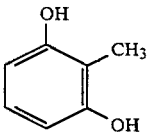
-continued
III-28
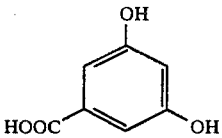
III-29
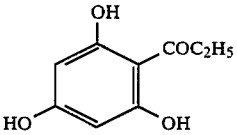
III-30
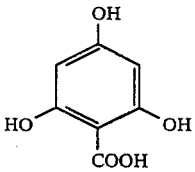
III-31
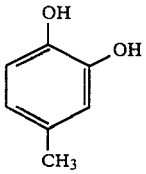
III-32
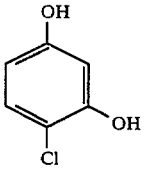
III-33
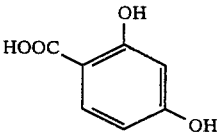
III-34
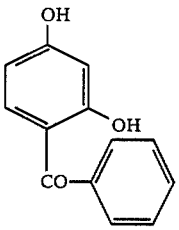
III-35
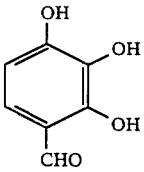
III-36
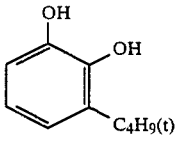

-continued

III-37

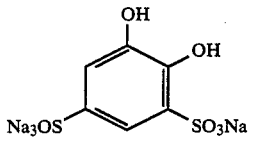

III-38

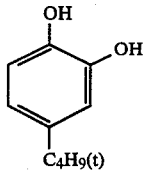

III-39

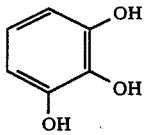

III-40

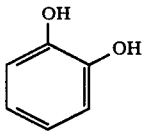

III-41

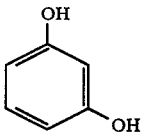

III-42

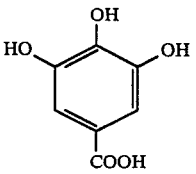

III-43

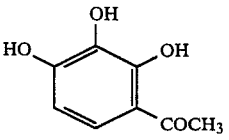

III-44

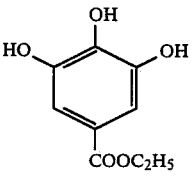

III-45

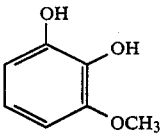

III-46

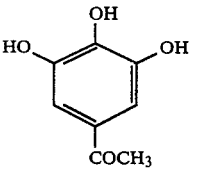

-continued

III-47

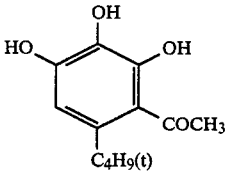

III-48

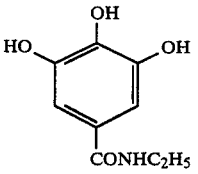

The hydrazine derivatives which can be used in the present invention preferably include those represented by formula (IV):

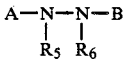

(IV)

wherein A presents an aliphatic group or an aromatic; B represents a formyl group, an acyl group, an alkyl- or arylsulfonyl group, an alkyl- or arylsufinyl group, a carbamoyl group, an alkoxy- or aryloxycarbonyl group, a sulfinamoyl group, an alkoxysulfonyl group, a thioacyl group, a thiocarbamoyl group, a sulfamoyl group, or a heterocylic group; and $R_5$ and $R_6$, which may be the same or different each represents hydrogen, a substituted or unsubstituted alkylsulfonyl group, a substituted or unsubstituted arylsulfonyl group, or a substituted or unsubstituted acyl group, provided that at least one of $R_5$ and $R_6$ represents hydrogen and B, $R_6$ and the nitrogen atom to which both are linked may form a partial structure of a hydrazone (—N=C<).

In formula (IV), the aliphatic group represented by A includes a substituted or unsubstituted straight or branched chain or cyclic alkyl group having up to 30, preferably up to 20, carbon atoms. The branched alkyl group may be cyclized to form a saturated hetero ring containing at least one hetero atom. The substituent for the alkyl group includes an aryl group, an alkoxy group, a sulfoxy group, a sulfonamido group, and a carbonamido group.

Specific examples of the alkyl group A include t-butyl, n-octyl, t-oxtyl, cyclohexyl, pyrrolidyl, imidazolyl, tetrahydrofuryl, and morpholino groups.

The aromatic group represented by A is a substituted or unsubstituted, monocyclic or bicyclic aryl group or a substituted or unsubstituted unsaturated heterocyclic group. The unsaturated heterocylic group may be condensed with a monocyclic or bicyclic aryl group to form a heteroaryl group.

Specific examples of the aromatic group include benzene, naphthalene, pyridine, pyrimidine, imidazole, pyrazole, quinoline, isoquinoline, benzimidazole, thiazole and benzothiazole rings, with those containing a ring being preferred. Typical substituents for the aromatic group include a straight or branched chain or cyclic alkyl group (preferably having from 1 to 20 carbon atoms), an aralkyl group (preferably containing a monocyclic or bicyclic aryl moiety and an alkyl moiety having from 1 to 3 carbon atoms), an alkoxy group (preferably having from 1 to 20 carbon atoms), a substituted amino group (preferably substituted by an alkyl group having from 1 to 20 carbon atoms), an acylamino group (preferably having from 2 to 30 carbon atoms), a sulfoamido group (preferably having from 1 to 30 carbon atoms) and a ureido group (preferably having from 1 to 30 carbon atoms).

Of these groups as A, particularly preferred are aryl groups.

A in formula (IV) may have incorporated therein a ballast group commonly employed in immobile photographic additives such as couplers. The ballast group is selected from groups that contain 8 or more carbon atoms and with relatively inert photographic characteristics, such as an alkyl group, an alkoxy group, a phenyl group, an alkylphenyl groups, a phenoxy group or an alkylphenoxy groups.

A in formula (IV) may further have incorporated therein a group enhancing adsorption onto silver halide grains. Such an adsorptive group includes those described in U.S. Pat. Nos. 4,385,108 and 4,459,347, JP-A-59-195233, 59-200231, 59-201045, 59-201046, 59-201047, 59-202048, 59-201049, 60-179734, 61-170733, and 62-948, such as a thiourea group, a heterocyclic thioamido group, a mercapto heterocyclic group or a triazole group.

B in formula (IV) specifically represents a formyl group, an acyl group (e.g., acetyl, propionyl, trifluoroacetyl, chloroacetyl, benzoyl, 4-chlorobenzoyl, pyruvoyl, methoxalyl, methyloxamoyl), an alkylsulfonyl group (e.g., methanesulfonyl, 2-chloroethanesulfonyl), an arylsulfonyl group (e.g., benzenesulfonyl), an alkylsulfinyl group (e.g., methanesulfinyl group), an aryl-sulfinyl group (e.g., benzenesulfinyl), a carbamoyl group (e.g., methylcarbamoyl, phenylcarbamoyl), a sulfamoyl group (e.g., dimethylsulfamoyl), an alkoxycarbonyl group (e.g., methoxycarbonyl, methoxyethoxycarbonyl), an aryloxycarbonyl group (e.g., a phenoxycarbonyl), a sufinamoyl group (e.g., methylsulfinamoyl), an alkoxysulfonyl group (e.g., methoxysulfonyl, ethoxysulfonyl), a thiacyl group (e.g., methylthiocarbonyl), a thiocarbamoyl group (e.g., methylthiocarbamoyl), or a heterocyclic group (e.g., pyridine).

Of these groups, prefered as B is a formyl group or an acyl group.

B, $R_6$, and the nitrogen atom to which they are bonded may form a partial structure of a hydrazone

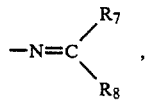

wherein $R_7$ represents an alkyl group; an aryl group or a heterocyclic group; and $R_8$ represents hydrogen, an alkyl group, an aryl group or a heterocylic group.

$R_5$ and $R_6$ each represents hydrogen, an alkyl- or arylsulfonyl group having up to 20 carbon atoms (preferably a phenylsulfonyl group or a phenylsulfonyl group substituted so as to have a sum of Hemmtt's $\sigma$ values of at least $-0.5$), or an acyl group having up to 20 carbon atoms (preferably a benzoyl group or a benzoyl group substituted so as to have a sum of Hemmtt's $\sigma$ values of at least $-0.5$, or a substituted or unsubstituted straight chain, branched, or cyclic aliphatic acyl group, the substituent therefor including a halogen atom, an ether group, a sulfonamido group, a carbonamido group, a hydroxyl group, a carboxyl group, a sulfo group). The most preferred group as $R_5$ or $R_6$ is a hydrogen atom.

Additional examples of the hydrazine derivatives which can be used in the present invention are described in *Research Disclosure,* 23516, P346 (Nov. 1983) and references cited therein, U.S. Pat. Nos., 4,080,207, 4,269,929, 4,276,364, 4,278,748, 4,384,108, 4,459,347, 4,560,638, and 4,478,928, British Pat. No. 2,011,391B, and JP-A-60-179734.

Specific examples of the hydrazine derivatives of formula (IV) are shown below, but the present invention is not to be construed as being limited thereto.

IV-1

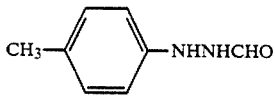

IV-2

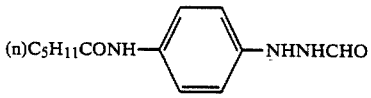

IV-3

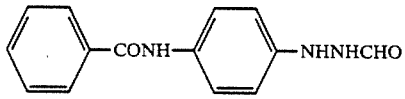

IV-4

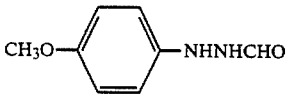

IV-5

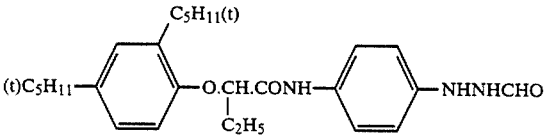

-continued
IV-6
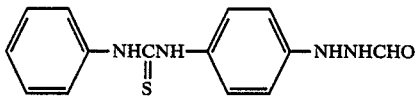
IV-7
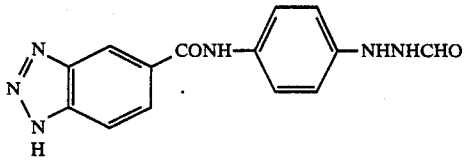
IV-8
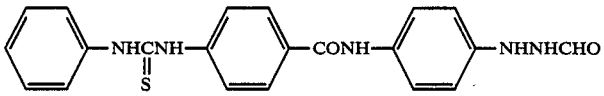
IV-9
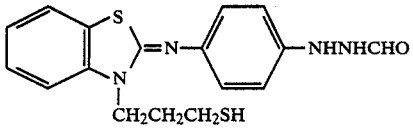
IV-10
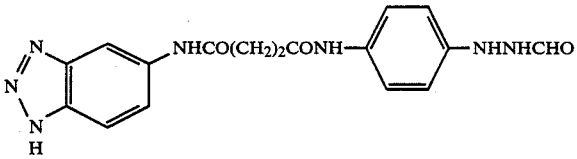
IV-11
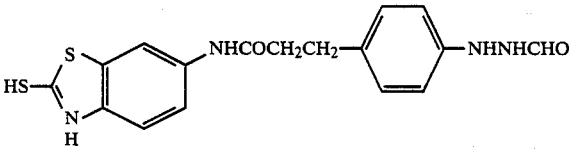
IV-12
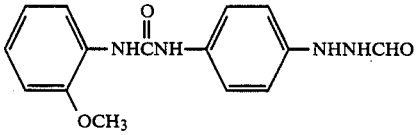
IV-13
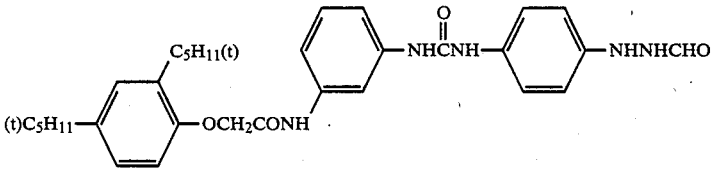
IV-14
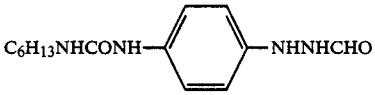
IV-15
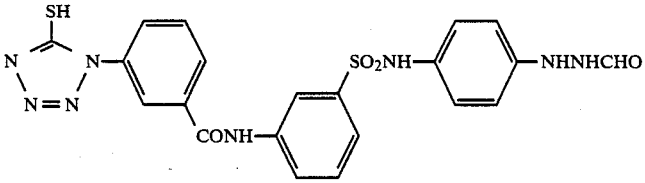

-continued
IV-16
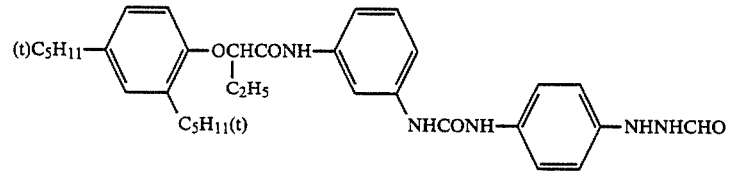
IV-17
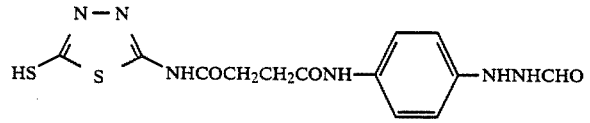
IV-18
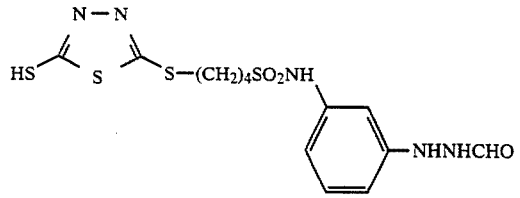
IV-19
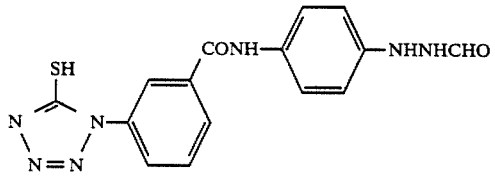
IV-20
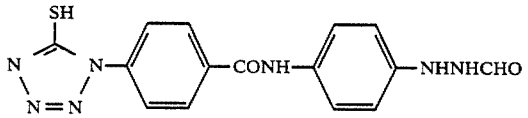
IV-21
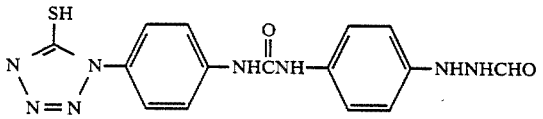
IV-22
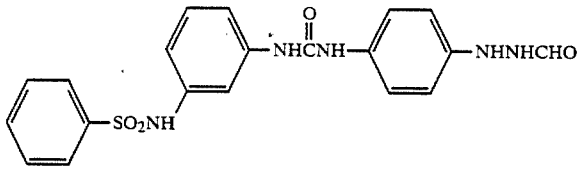
IV-23
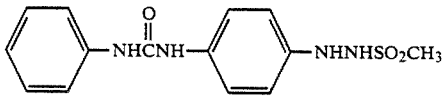
IV-24
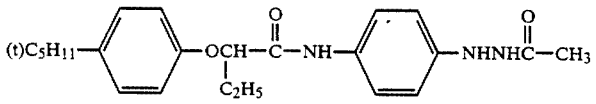
IV-25
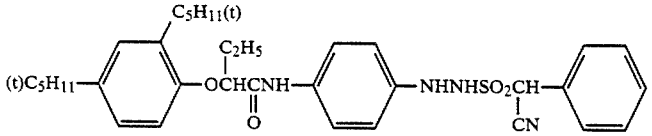

-continued

IV-26

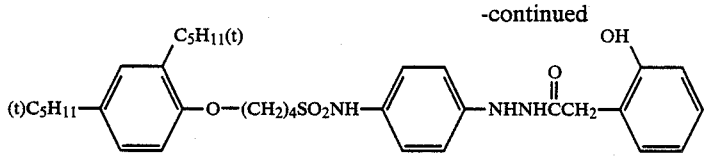

IV-27

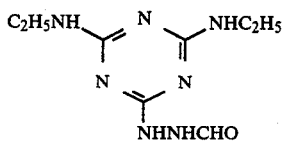

IV-28

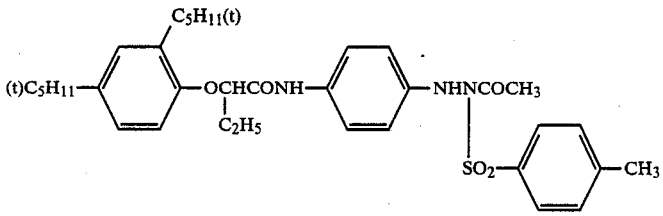

IV-29

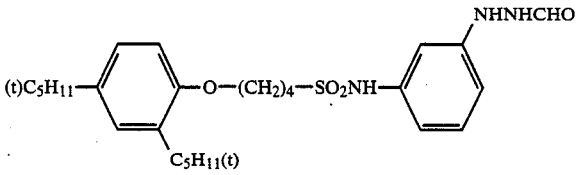

IV-30

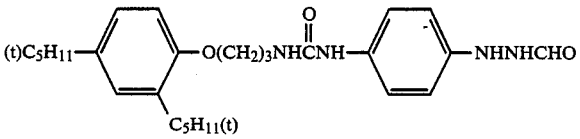

IV-31

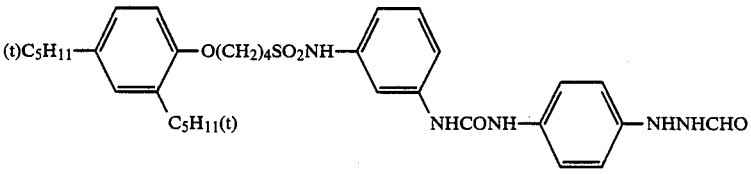

In the present Invention, the compound of formula (I), the compound(s) of formula (II) and/or (III), and the hydrazine derivative are preferably incorporated in a silver halide emulsion layer, but may be incorporated in other light-insensitive hydrophilic colloidal layers, such as a protective layer, an intermediate layer, a filter layer, an anti-halation layer, and the like. These compounds may be incorporated in the same layer or in the different layers, but preferably may be incorporated in the same layer. Incorporation of these compounds can be carried out by dissolving each of them in water in case of using a water-soluble compound or in a water-miscible organic solvent, e.g., alcohols, esters, or ketones, in case of using a sparingly water soluble compound, and adding the solution to a hydrophilic collidal solution. When it is added to a silver halide emulsion layer, addition may be effected at any stage of from the commencement of chemical ripening up to the stage immediately before coating, and preferably from the end of chemical ripening to the stage before coating. In particular, the compound is preferably added to a coating composition ready to be coated.

The amount of the compound of formula (I) to be added is desirably selected so as to obtain the best results depending on the grain size and halogen composition of silver halide grains, the method and degree of chemical sensitization, the relationship between the layer to which the compound is added and a silver halide emulsion layer, the kind of antifoggant used, the the like. Such selection can be made easily be one skilled in the art. Usually, the compound of formula (I) is preferably used in an amount ranging from $1\times10^{-6}$ to $1\times10^{2}$ mol, and more preferably from $1\times10^{-5}$ to $5\times10^{-3}$, per mole of silver halide.

The amounts of the compounds of formulae (II) and (III) and the hydrazine derivative can also be determined in the same manner as described above. Usually, the compound of formula (II) is preferably added in an amount ranging from $1\times10^{-6}$ to $5\times10^{-2}$ mol, and more preferably from $3\times10^{-5}$ to $1\times10^{-2}$ mol, per mole of silver halide. The compound formula (III) is preferably added in an amount of from $1\times10^{-6}$ to $1\times10^{-1}$ mol, and more preferably from $5\times10^{-3}$ to $7.5\times10^{-2}$ mol, per mole of silver halide. When the mixture of the compound of formula (II) and the compound of formula (III) is used, the compounds formulae (II) and (III) each is preferably added in an amount of from $3\times10^{-5}$ to $1\times10^{-2}$ and from $5\times10^{-5}$ to $7.5\times10^{-2}$, and more preferably from $5\times10^{-4}$ to $1\times10^{-2}$ and from $1\times10^{-4}$ to $5\times10^{-2}$, respectively. The hydrazine derivative is preferably added in an amount of from $1\times10^{-6}$ to $1\times10^{-1}$ mol, and more preferably from $1\times10^{-5}$ to $4\times10^{-3}$, per mole of silver.

The silver halide emulsions which can be used in the present invention may have any halogen composition, including silver chloride, silver chlorobromide, silver iodobromide, silver iodochlorobromide with silver iodobromide being preferred. The silver iodide content is preferably not more than 10 mol %, more particularly between 0.1 to 3.5 mol %.

The silver halide grains used preferably have a small mean diameter (e.g., not more than 0.7 μm), particularly not more than 0.5 μm. The grain size distribution is not critical, but mon-disperse emulsions having a narrow size distribution are preferred. The terminology "mono-disperse" as used herein means that at least 95% of total weight or number of silver halide grains is in the size range within ±40% of the mean grain size.

The silver halide grians may have a regular crystal form, such as cubic, octahedral, tetradecahedral and rhombic dodecahedral forms, with cubic or tetradecahedral grains being particularly preferred, or an irregular crystal form, e.g., a spherical form, a tabular form, and a tabular form having an aspect ratio of from 3 to 20, or may have a composite crystal form thereof.

The silver halide grains may have a homogeneous phase throughout the individual grains or a heterogeneous phase having a core-shell structure. Tow or more silver halide emulsions separately prepared may be used as a mixture.

In the course of grain formation of physical ripening, a cadminum salt, a sulfite, a lead salt, a thallium salt, a rhodium salt or a complex salt thereof, an iridium salt or a complex salt thereof may be present in the system.

The silver halide which is particularly suitable for use in this invention is a silver haloiodide whose surface portion has a greater silver iodide content than the average of individual garins, which is prepared in the presence of from $10^{-8}$ to $10^{-5}$ mol fo an iridium salt or a complex salt thereof per mol of silver. Use of an emulsion containing such a silver haloiodide brings about higher sensitivity and higher gamma. It is desirable to add the prescribed amount of an iridium salt by the end of physical ripending, and particularly during grain formation. The iridium salt to be added includes a water-soluble iridium salt or a complex salt thereof, e.g., iridium trichloride, iridium tetrachloride, potassium hexachloroididate (III), potasium hexachloroiridate (IV), and ammonium hexachloroiridate (III).

The silver halide emulsion used in the present invention may or may not be subjected to chemical sensitization. Chemical sensitization can be carried out by any of sulfur sensitization, reduction sensitization, noble metal sensitization and a combination thereof. Among these techniques, sulfur sensitization is preferred.

Sulfur sensitization is effected by using sulfur compounds contained in gelatin and other various sulfur compounds, such as thiosulfates, thioureas, thiazoles, and rhodanines. Specific examples of these sulfur sensitizers are described in U.S. Pat. Nos., 1,574,944, 2,278,947, 2,410,689, 2,728,668, 3,501,313, and 3,656,955. Preferred among them are thiosulfates and thiourea compounds. The pAg value during the sensitization is preferably controlled at 8.3 or less, more preferably between 7.3 and 8.0. A combined use of polyvinylpyrrolidone and a thiosulfate as reported by Moisar, *Klein Gelatine Proc. Symp.*, 2nd Ed., 301 to 309 (1970) is also advantageous.

Noble metal sensitization is typically carried out by gold sensitization using gold compounds, mostly gold complex salts. Complex salts of noble metals other than gold, e.g., platinum, palladium, iridium, etc., may also be used. Specific examples of gold sensitizaion are described, e.g., in U.S. Pat. No. 2,448,060 and British Pat. No. 618,061.

Reduction sensitization is effected by using a reducing agent, such as stannous salts, amines, formamidinesulfinic acid, or silane compounds. Specific examples of reduction sensitization are given to U.S. Pat. Nos. 2,487,850, 2,518,698, 2,983,609, 2,983,610 and 2,694,637.

The silver halide emulsion used in the light-sensitive material may be of a single kind or of two or more kinds differing, for examples, in mean grain size, halogen composition, crystal habit, or condition of chemical sensitization. When two kinds of a silver halide emulsion are used, it is preferred for increasing maximum density to use two kinds of mono-disperse emulsions differeing in average grain size as disclosed in JP-A-61-223734 and 62-90646. The smaller mono-disperse grains are preferably subjeced to chemical sensitization, preferably sulfur sensitization. The largeer mono-disperse grains may or may not be chemically sensitized. Since large mono-disperse grains generally tend to cause black pepper, it is preerred that they are not subjected to chemical sensitization at all or, if subjected, the chemical sensitization should be effected so lightly that no black pepper may occur by, for example, making the time of chemical sensitization shorter, employing lower temperatures or controlling the amount of a chemical sensitizer to be used as compared with the chemical sensitization of the smaller grains. The difference in sensitivity between the mono-disperse emulsion having the greater grain size and that having the smaller grain size is not particularly limited, but preferably ranges from 0.1 to 1.0, more preferably from 0.2 to 0.7, being expressed in ΔlogE, with the sensitivity of the larger size emulsion being preferably higher.

The silver halide emulsion layer may be composed of a single layer or multiple layers. In the latter case, the two or more emulsions may be the same or different.

Binders or protective colloids for photographic emulsions include gelatin and other hydrophilic colloids, such as proteins, e.g., gelatin derivatives, grafted polymers of gelatin and other high polymers, albumin, casein; cellulose derivatives, e.g., hydroxyethyl cellulose, carboxymethyl cellulose, cellulose sulfate; sugar derivatives, e.g., sodium alginate, starch derivatives; and a wide variety of synthetic hydrophilic high polymers, e.g., polyvinyl alcohol, polyvinyl alcohol partial acetal, poly-N-vinylpyrrolidone, polyacrylic acid, polymethacrylic acid, polyacrylamide, polyvinylimidazole, polyvinylpyrazole, or copolymers of monomers constituting these homopolymers.

The Gelatin to be used includes not only lime-processed gelatin but acid-processed gelatin, hydrolysis products of gelatin, and enzymatic decomposition products of gelatin.

The photographic emulsion can also be spectrally sensitized so as to have sensitivity to the longer wavelength region than the intrinsic sensitivity region by the use of sensitizing dyes having an absorption maximum in the visible region as described in JP-A-55-520250, pp 45-53 (e.g., cyanine dyes and merocyanine dyes).

These sensitizing dyes may be used either individually or in combinations thereof. Combinations of sensitizing dyes are frequently employed for the particular purpose of supersensitization. The emulsion may further contain, in combination with the sensitizing dyes, a dye ro substance producing a supersensitizing effect, though showing no spectral-sensitizing activity by itself or no substnatial absorption of visible light. Examples of useful sensitizing dyes, combinations of dyes for supersensitization, and substances producing supersensitizing effects are described in *Research disclosure,* Vol. 176, No. 17643, p23, IV-J (Dec., 1978).

For the purpose of preventing fog during preparation, preservation or photographic processing of the photographic materials or stabilizing photographic performance properties, the photographic emulsion layers can contain various compounds known as antifoggants or stabilizers. Such compounds include azolies, e.g., benzothiazolium salts, nitroinidazoles, chlorobenzimidazoles, bromobenzimidazoles, mercaptotetrazoles, mercaptothiazoles, mercaptobenzothiazoles, mercaptothiadiazoles, aminotriazoles, benzothiazoles, nitrobenzotriazoles; mercaptopyrimidines; mercaptotriazines; thioketo compounds, e.g., oxazolinethione; azaindenes, e.g., triazaindenes, tetraazaindenes (particularly 4-hydroxysubstituted(1,3,3a,7)tetraazaindenes), pentaazaindenes; benzenethiosulfonic acid, benzenesulfinic acid, and benzenesulfonic acid amide. Preferred are benzotriazoles (e.g., 5-methylbenzotriazole) and nitroindazoles (e.g., 5-nitroindazole). These compounds may be incorporated into a processing solution. In addition, compounds capable of releasing a development inhhitor during development (e.g., those described in JP-A-62-30243) can be used as stabilizer or black pepper inhibitor.

The photographic light-sensitive materials of the present invention can further contain a developing agent such as hydroquinone derivatives and 1-phenyl-3-pyrazolidone derivatives as stabilizer or accelerator.

The photographic emulsion layers or other hydrophilic colloidal layers may contain organic or inorganic hardening agents. Examples of the hardening agents include chromates (e.g., chromium alum, chromium acetate), aldehydes (e.g., formaldehyde, glutaraldehyde), N-methylol compounds (e.g., dimethylolurea), dioxane derivatives, active vinyl compounds (e.g., 1,3,5-triacryloyl-hexahydro-s-triazine, 1,3-vinyl-sulfonyl-2-propanol), active halogen compounds (e.g., 2,4-dichloro-6-hydroxy-s-triazine), and nucohalogenic acids (e.g., nucochloric acid). These hardening agents may be used either individually or in combinations thereof.

Preferred hardening agents are active vinyl compounds represented by formula (V):

$$CH_2{=}CHSO_2{-}A_1{-}SO_2CH{=}CH_2 \qquad (V)$$

wherein $A_1$ represents an alkylene group or an alkylene group substitued with a halogen atom, a hydroxyl group, a hydroxylalkyl group or an amino group, which may contain an amido linkage, an ether linkage or a thioether linkage.

Specific examples of the vinyl compounds of formula (V) are shown below, but the present invention is not to be construed as being limited thereto:

V-1: $CH_2{=}CHSO_2CH_2SO_2CH{=}CH_2$

-continued

V-2: $CH_2{=}CHSO_2(CH_2)_2SO_2CH{=}CH_2$

V-3: $CH_2{=}CHSO_2(CH_2)_4SO_2CH{=}CH_2$

V-4: $CH_2{=}CHSO_2CH_2OCH_2SO_2CH{=}CH_2$

V-5: $CH_2{=}CHSO_2(CH_2)_2O(CH_2)_2CH_2SO_2CH{=}CH_2$

V-6: $CH_2{=}CHSO_2CH_2\overset{OH}{\overset{|}{C}}HCH_2SO_2CH{=}CH_2$

V-7: $\left.\begin{array}{l} CH_2{=}CHSO_2CH_2CONH \\ CH_2{=}CHSO_2CH_2CONH \end{array}\right\}(CH_2)_2$ V-8: $\left.\begin{array}{l} CH_2{=}CHSO_2CH_2CONH \\ CH_2{=}CHSO_2CH_2CONH \end{array}\right\}(CH_2)_3$ The amount of the gelatin hardening agent is desirably determined depending on the kind of the hardening agent and the kind of gelatin. Usually, it is in the range of from 0.5 to $50\times10^{-3}$ mol, preferably from 2 to $20\times10^{-3}$ mol, per 100 g of gelatin.

The photographic emulsion layers or other hydrophilic colloidal layers of the photographic materials may further contain various surface active agents as coating aid or antistatic or for improvement of slip properties, improvement of emulsifying dispersibility, prevention of adhesion, improvement of photographic characteristics (e.g., acceleration of development, increase of contrast and increase of sensitivity), and the like.

Examples of the surface active agent to be added include nonionic surface active agnts, such as saponin (steroid type), alkylene oxide derivatives (e.g., polyethylene glycol, polyethylene glycol/polypropylene glycol condensation products, polyethylene glycol alkyl ethers or alkylaryl ethers, polyethylene glycol ester, polyethylene glycol srobitan esters, polyalkylene glycol alkylamines or amides, silicon-polyethylene oxide addusts), glycidol derivatives (e.g., alkenylsuccinic polyglycerides, alkylphenyl polyglycerides), fatty acid esters of polyhydric alcohols, and lkyl esters of sugers; anionic surface active agents containing an acid group (e.g., carboxyl, sulfo, phospho, sulfate, and phosphate groups), such as alkylcarboxylates, alkylsulfonates, alkylbenzenesulfonates, alkylnaphthalenesulfonates, alkylsulfates, alkyl phosphates, N-acyl-N-alkyltaurines, sulfosuccinates, sulfoalkylpolyoxyethylene alkylphenyl ethers, polyoxyethylene alkylphosphate; amphoteric surface active agents, such as amino acids, aminoalkylsulfonic acids, amiknoalkyl sulfates or phosphates, alkylbetaines, amino oxides and cationic surface active agents, such as alkylamine salts, aliphatic or aromatic quaternary ammonium salts, heterocyclic quaternary ammonium salts, e.g., pyridinium, imidazolium, aliphatic or heterocyclic phosphonium or sulfonium salts. Of these particularly preferred are polyalkylene oxides having a molecular weight of 600 or more as described in JP-B-58-9412. For particular use as antistatic agents, fluorine-containing surface active agents described, e.g., in JP-A-60-80849 are preferred.

The photographic emulsion layers and other hydrophilic colloidal layers may further contain a hydroquinone derivative capable of releasing a development inhibitor during development in proportion to the image density ("DIR-hydroquinone"). Specific examples of the DIR-hydroquinone are described in U.S. Pat. Nos., 3,379,529, 3,620,746, 4,377,634, and 4,332,878, and JP-A-49-129536, 54-67419, 56-153336, 56-153342, 59-278853, 59-90435, 59-90436, and 59-138808.

The photographic emulsion layers and other hydrophilic colloidal layers can contain a matting agent for preventing blocking, such as silica, magnesium oxide, or polymethyl methacrylate.

For the purpose of improving dimensional stability, the light-sensitive materials of the invention can contain a dispersion of a water-insoluble or sparingly water-soluble synthetic polymer, such as a homo- or copolymer of an alkyl (meth)acrylate, an alkoxyacryl (meth)acrylate, a glycidyl (meth)acrylate and a copolymer of these monomers and acryic acid, methacrylic acid.

The silver halide emulsion layers and other layers of the photographic materials of this invention preferably contain compounds having an acid radical. Included in such compounds are organic acids, e.g., salicylic acid, acetic acid, and ascorbic acid; and homo- or copolymers containing an acidic cmonomer, e.g., acrylic acid, maleic acid, phthalic acid, in JP-A-61-2233834, 61-228437, 62-25745, and 62-55642. Preferred are ascorbic acid as a low-molecular compound and an aqueous latex of a copolymer comprising an acidic monomer (e.g., acrylic acid) and a crosslinking monomer having two or more unsaturated grous (e.g., divinylbenzene).

The support to be used in the photographic materials includes glass, a cellulose acetate film, a polyethylene terephthalate film, paper, baryta paper, polyolefin-coated paper, and the like.

The silver halide photographic materials according to the present invention can be processed with a stable developer to achieve photographic characteristics of ultra-high contrast and high sensitivity. There is no need to use a highly alkaline developer at a pH near to 13 as is employed in conventional infectious development systems and U.S. Pat. No. 2,419,975. This is, a sufficiently hard negative image can be obtained by using a developer containing 0.15 mol/l or more of a sulfite ion as a preservative and having a pH of from 10.5 to 12.3, particularly from 11.0 to 12.0.

The developing agent to be used in the developer is not particularly limited. From the standpoint of ease of obtaining satisfactory dot image quality, dihydroxybenzene developing agents are preferred. A combination of a dihydroxybenzene developing agent with a 1-phenyl-3-pyrazolidone developing agent or with a p-aminophenol developing agent is also employable.

The dihydroxybenzene developing agents include hydroquinone, chlorohydroquinone, bromohydroquinone, isopropylhydroquinone, methylhydroquinone, 2,3-dichlorohydroquinone, 2,5-dichlorohydroquinone, 2,3-dibromohydroquinone, and 2,5-dimethylhydroquinone, with hydroquinone being particularly preferred.

The 1-phenyl-3-pyrazolidone developing agents include 1-phenyl-3-pyrazolidone, 1-phenyl-4,4-dimethyl-4-pyrazolidoen, 1-phenyl-4-methyl-4-hyedroxymethyl-3-pyrazolidone, 1-phenyl-4,4-dihydroxymethyl-3-pyrazolidone, 1-phenyl-5-methyl-3-pyrazolidone, 1-p-aminophenyl-4,4-dimethyl-3-pyrazolidone, and 1-p-tolyl-4,4-dimehtyl-3-pyrazolidone.

The p-aminophenol developing agents include N-methyl-p-aminophenol, p-aminophenol, N-$\beta$-hydroxyethyl)-p-aminophnol, N-(4-hydroxyphenyl)glycine, 2-methyl-p-aminophenol, and p-benzylaminophenol, with N-methyl-p-aminophenol being preferred.

These developing agents are generally used in an amount of from 0.05 to 0.8 mol/l. In cases wherein the dihydroxybenezene is combined with the 1-phenyl-3-pyrazolidone or p-aminophenol, the former is used in an amount of from 0.05 to 0.5 mol/l, and the latter 0.06 mol/l or less.

The sulfite preservative which can be used in the developer includes sodium sulfite, potassium sulfite, lithium sulfite, ammonium sulfite, sodium bisulfite, potassium metabisulfite, and formaldehyde sodium bisulfite. The sulfite is preferably used at a concentration of at least 0.15 mol/l, more preferably 0.5 mol/l or more. The upper limit of the sulfite concentration is preferably 2.5 mol/l.

The developer is adjusted to the above-recited pH (10.5 and 12.3) by an alkali agent, e.g., sodium hydroxide, potassium hydroxide, sodium carbonate, potassium carbonate, sodium tertiary phosphate, or potassium tertiary phosphate.

In addition to these compounds, the developer can further contain compounds like boric acid and borax; development restrainers, e.g., potassium bromide and potassium iodide; organic solvents, e.g., ethylene glycol, diethylene glycol, triethylene glycol, dimethylformamide, methyl cellosolve, hexylene glycol, ethanol, and methanol; antifoggants or black pepper inhibitors such as 1-phenyl-5-mercaptotetrazole, indazole compounds (e.g., 5-nitroindazole), and benzotriazole compounds (e.g., 5-methylbenzotriazole); toning agents; surface active agents, defoaming agents; water softeners; hardening agents; amino compounds described in JP-A-56-106244; silver stain inhibitors described in JP-A-56-24347; dissolving aids described in Japanese patent application No. 60-109743; and pH buffers described in JP-A-60-93433 and Japanese patent application No. 61-28708.

The composition of a fixer to be used in the present invention is conventional. The fixing agent includes thiosulfates, thiocyanates and, in addition, organic sulfur compounds known to have fixing effects. The fixer may contain a water-soluble aluminum salt (e.g., aluminum sulfate, alum) as a hardening agent. The amount of the water-soluble aluminum salt usually ranges from 0.4 to 2.0 g per liter on an aluminum conversion. An ethylenediaminetetraacetate-iron (III) complex can also be added to the fixer.

The development processing is usually conducted at a temperature between 18° C. and 50° C., preferably between 25° C. and 43° C.

The present invention is now illustrated in greater detail with reference to the following specific Examples, but the present invention is not to be contrued as being limited thereto. Unless otherwise indicated, all parts, precents and ratios are by weight.

EXAMPLE 1

Preparation of Emulsion A

To a gelatin aqueous solution kept at 50° C. were added simultaneously a silver nitrate aqueous solution and an aqueous solution containing potassium iodide and potassium bromide over a period of 60 minutes in the presence of $4\times10^{-7}$ mol/mol-Ag of potassium hexachloroiridate (III) and ammonia. During the addition, the pAg of the system was maintained at 7.8. There was prepared a mono-disperse emulsion A of cubic silver iodobromide having a mean grain size of 0.25 μm and an average silver iodide content of 2 mol %. After desalting by a flocculation method, hypo was added thereto, and the system was kept at 60° C. to effect chemical ripening.

To Emulsion A were added $3\times10^{-4}$ mol/mol-Ag of 5,5'-dichloro-9-ethyl-3,3'-bis(3-sulfopropyl)oxacarbocyanine (the same as Comparative compound (a) hereinafter shown) as a sensitizing dye and the compound of formula (I) and the compound of formula (II) as shown in Table 1. Then, $3\times10^{-3}$ mol/mol-Ag of a hydrazine derivative (IV-5) and, as a stabilizer, 4-hydroxy-6-methyl-1,3-3a,7-tetraazaindene and $2\times10^{-4}$ mol/mol-Ag of a mercaptotetrazole compound of formula (1) shown below, hydroquinone, polyethylene glycol (molecular weight: 1000), a dispersion of polyethy acryalte (particle size), and 1,3-divinylsulfonyl-2-propanol were further added thereto. The resulting coating composition was coated on a polyethylene terephthalate film thick to a silver coaverage of 3.4 g/m$^2$ (gelatin coverage: 2 g/m$^2$). On the emulsion layer was simultaneously coated a protective layer containing 1.3 g/m$^2$ of gelatin, 50 mg/m$^2$ of polymethyl methacrylate particles having a particle diameter of 2.5 μm, 0.15 g/m$^2$ of methanol silica and, as coating adis, a fluorine-containing surface active agent of formula (2) shown below and sodium dodecylbenzenesulfonate.

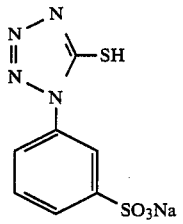

(1)

$C_8F_{17}SO_2N(C_3H_7)CH_2COOK$ (2)

Each of the resulting samples was exposed to light and developed with Developer A or B having the following formulation at 38° C. for 30 seconds by the use of an automatic developing machine ("FG-660F" manufactured by Fuji Photo Film Co., Ltd.).

| Formulation of Developer A: | |
|---|---|
| Hydroquinone | 45.0 g |
| N-Methyl-p-aminophenol hemisulfate | 0.8 g |
| Sodium hydroxide | 18.0 g |
| Potassium hydroxide | 55.0 g |
| 5-Sulfosalicyclic acid | 45.0 g |
| Boric acid | 25.0 g |
| Potassium sulfite | 110.0 g |
| Disodium ethylenediaminetetraacetate | 1.0 g |
| Potassium bromide | 6.0 g |
| 5-Methylbenzotriazole | 10.6 g |
| n-Butyldiethanolamine | 15.0 g |
| Water to make | 1 l |
| | (pH = 11.6) |

PHOTOGRAPHIC PROPERTIES

Developer A after having been used for processing 150 films ("GO-100", orthochromatic lith film produced by Fuji Photo Film; 50.8 cm×61 cm) having a blackening degree of 100%.

The photographic characteristics of the samples were evaluated as follows.

Sensitivity was evaluated by determining the reciprocal of an exposure providing a density of 1.5. The result was relatively expressed taking the sensitivity of Sample 101 as a standard (100).

Separately, each of the samples was developed in the same manner as described above, except for using Developer A after having been fatigued for 1 week without replanishment so as to have a pH increased by 0.05 and a sulfite ion concentration reduced by half. Black pepper of the thus processed sample was microscopically observed, and the degree of black pepper inhibition was rated according to the following reating system:

5 . . . Excellent
4 . . . Good (suitable for practical use)
3 . . . Poor (the lowest level permitting practical used)
2 . . . Bad (impractical)
1 . . . Worst.

A degree of black pepper inhibition in the middle between two grades was expressed by point five as in 3.5 between 3 and 4.

Further, each of the samples was separately developed with Developer A at 38° C. for 20 seconds. Color remaining due to a sensitizing dye was evaluated by visually observing the hue of the unexposed area of the processed sample and rated in five grades (Grade 5 is the best, and Grade 1 is the worst).

The result of these evaluations are shown in Table 1 below.

TABLE 1

| Sample No. | Compound of Formula (I) | | Compound of Formula (II) | | Photographic Characteristics | | | | | | Black Pepper | Color Remaining |
|---|---|---|---|---|---|---|---|---|---|---|---|---|
| | | | | | Developer A | | | Developer B | | | | |
| | Compound No. | Amount Added (mol/mol-Ag) | Compound No. | Amount Added (mol/mol-Ag) | Relative Sensitivity | Gamma | $D_{max}$ | Relative Sensitivity | Gamma | $D_{max}$ | | |
| 101 | — | — | — | — | 100 | 16.0 | >6.0 | 85 | 12.0 | 5.0 | 3 | 5 |
| 102 | I-3 | $2 \times 10^{-4}$ | — | — | 100 | 15.8 | >6.0 | 81 | 12.0 | 4.8 | 4 | 5 |
| 103 | " | $4 \times 10^{-4}$ | — | — | 98 | 15.0 | 5.9 | 79 | 11.0 | 4.7 | 5 | 5 |
| 104 | I-15 | $2 \times 10^{-4}$ | — | — | 100 | 15.7 | 5.9 | 83 | 12.2 | 4.9 | 4 | 5 |
| 105 | " | $4 \times 10^{-4}$ | — | — | 95 | 15.4 | 5.8 | 81 | 11.0 | 4.8 | 5 | 4 |
| 106 | — | — | II-1 | $5 \times 10^{-4}$ | 102 | 18.2 | >6.0 | 98 | 17.8 | 5.6 | 1 | 5 |
| 107 | — | — | " | $1 \times 10^{-3}$ | 105 | 19.8 | >6.0 | 100 | 19.0 | 5.7 | 1 | 5 |
| 108 | — | — | II-5 | $5 \times 10^{-4}$ | 105 | 18.4 | >6.0 | 102 | 16.9 | 5.8 | 1 | 5 |
| 109 | — | — | " | $1 \times 10^{-3}$ | 107 | 20.0 | >6.0 | 102 | 18.8 | 5.9 | 1 | 5 |
| 110 | I-3 | $2 \times 10^{-4}$ | II-1 | $5 \times 10^{-4}$ | 100 | 18.0 | >6.0 | 98 | 17.0 | 5.6 | 4 | 5 |
| 111 | " | " | " | $1 \times 10^{-3}$ | 102 | 19.0 | >6.0 | 98 | 17.8 | 5.8 | 4 | 5 |
| 112 | " | $4 \times 10^{-4}$ | II-5 | $5 \times 10^{-4}$ | 100 | 18.5 | >6.0 | 95 | 17.8 | 5.7 | 5 | 4 |
| 113 | " | " | " | $1 \times 10^{-3}$ | 102 | 19.0 | >6.0 | 98 | 18.0 | 5.8 | 5 | 4 |
| 114 | I-15 | " | II-1 | $5 \times 10^{-4}$ | 98 | 18.2 | >6.0 | 95 | 16.9 | 5.7 | 4.5 | 4 |
| 115 | " | " | " | $1 \times 10^{-3}$ | 102 | 19.0 | >6.0 | 98 | 17.8 | 5.8 | 4 | 4 |
| 116 | I-15 | $4 \times 10^{-4}$ | II-5 | $5 \times 10^{-4}$ | 100 | 17.8 | >6.0 | 95 | 17.2 | 5.7 | 4.5 | 4 |
| 117 | " | " | " | $1 \times 10^{-3}$ | 102 | 18.8 | >6.0 | 100 | 18.0 | 5.8 | 4 | 4 |
| 118 | Comparative Compound a | $2 \times 10^{-4}$ | II-1 | " | 105 | 18.0 | >6.0 | 100 | 17.2 | 5.8 | 3 | 2 |
| 119 | Comparative Compound a | $4 \times 10^{-4}$ | " | " | 98 | 17.6 | 5.9 | 93 | 16.6 | 5.6 | 4 | 1 |
| 120 | Comparative Compound b | $2 \times 10^{-4}$ | " | " | 100 | 18.1 | >6.0 | 93 | 17.0 | 5.7 | 2.5 | 2 |
| 121 | Comparative Compound b | $4 \times 10^{-4}$ | " | " | 95 | 17.0 | 5.8 | 89 | 15.9 | 5.5 | 3.5 | 1 |

Note:
Comparative Compound a:

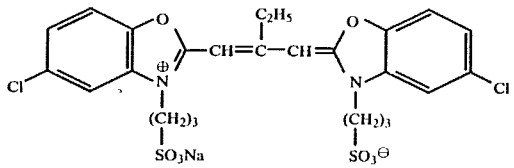

Comparative Compound b:

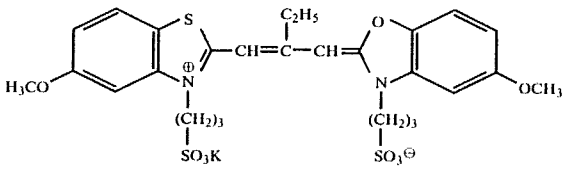

As is apparent from Table 1, samples 110 to 117 according to the present invention exhibited a high level of maximum density, which was maintained even when processed with a developer having been used for processing a large volume of films. They also proved satisfactorily free from black pepper even when processed with a developer having an increased pH and a decreased sulfite ion concentration.

EXAMPLE 2

Preparation of Emulsion B

In the same manner as for Emulsion A of Example 1 but the amount of ammonia being controlled, a monodisperse emulsion of cubic silver iodobromide having a mean grain size of 0.3 μm and an average silver iodide content of 2 mol % (Emulsion B) was prepared. Emulsion B was subjected to desalting by a flocculation method.

The procedure of Example 1 was repeated, except for using Emulsion B in place of Emulsion A and Compound (I-17), (I-16), or (I-18) as compound as formula (I) and Compound (II-2), (II-10), (II-20) or (II-32) as compound of formula II. As a result, the present invention was proved satisfactory.

EXAMPLE 3

To Emulsion A as prepared in Example 1 were added, as sensitizing dyes, Compound (II-24) or (II-21) or Comparative Compound a, b as shown above comparative compounds c and d and Compound (I-26) as shown in Table 2 below. To the emulsion were further added $3\times10^{-4}$ mol/mol-Ag of Compound (IV-5), $5\times10^{-4}$ mol/mol-Ag of a compound of formula (3) shown below, and the other same additives as used in Example 1, except for the mercaptotetrazole compound of formula (1). The resulting coating composition was coted on a polyethylene ter5ephthalate film to a silver coverage of 3.3 g/m$^2$ together with the same protective layer as used in Example 1.

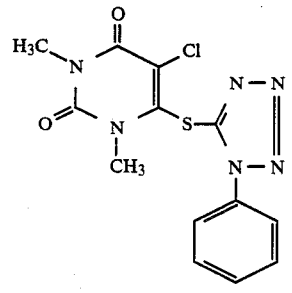

Each of the resulting samples was exposed to light, developed, an evaluated for photographic characteristics in the same manner as in Example 1. The results obtained are shown in Table 2.

TABLE 2

| Sample No. | Compound of Formula (I) | | Compound of Formula (II) | | Photographic Characteristics | | | | | | Black Pepper | Color Remaining |
|---|---|---|---|---|---|---|---|---|---|---|---|---|
| | | | | | Developer A | | | Developer B | | | | |
| | Compound No. | Amount Added (mol/mol-Ag) | Compound No. | Amount Added (mol/mol-Ag) | Relative Sensitivity | Gamma | $D_{max}$ | Relative Sensitivity | Gamma | $D_{max}$ | | |
| 301 | — | — | — | — | 28 | 8 | 4.0 | 27 | 8 | 3.9 | 3 | 5 |
| 302 | — | — | Comparative Compound a | $5 \times 10^{-4}$ | 100 | 16.0 | >6.0 | 81 | 12 | 4.8 | 3 | 4 |
| 303 | I-26 | $2 \times 10^{-4}$ | Comparative Compound a | " | 98 | 15.8 | >6.0 | 81 | 12.2 | 4.8 | 4.5 | 4 |
| 304 | " | $4 \times 10^{-4}$ | Comparative Compound a | " | 95 | 15.6 | >6.0 | 79 | 11.8 | 4.7 | 5 | 4 |
| 305 | — | — | Comparative Compound a | $1 \times 10^{-3}$ | 102 | 16.0 | >6.0 | 81 | 12.0 | 4.8 | 5 | 1 |
| 306 | — | — | Comparative Compound a | $1.5 \times 10^{-3}$ | 95 | 14.8 | >6.0 | 79 | 11.6 | 4.6 | 5 | 1 |
| 307 | — | — | II-24 | $5 \times 10^{-4}$ | 126 | >20 | >6.0 | 117 | 19.8 | 5.8 | 1.5 | 5 |
| 308 | — | — | " | $1 \times 10^{-3}$ | 126 | >20 | >6.0 | 115 | 19.6 | 5.9 | 1 | 4.5 |
| 309 | I-26 | $3 \times 10^{-4}$ | " | $5 \times 10^{-4}$ | 123 | >20 | >6.0 | 115 | 19.0 | 5.8 | 4.5 | 5 |
| 310 | " | $6 \times 10^{-4}$ | " | " | 120 | 19.2 | >6.0 | 110 | 18.8 | 5.7 | 5 | 5 |
| 311 | " | — | II-21 | $5 \times 10^{-4}$ | 117 | >20 | >6.0 | 110 | 19.0 | 5.8 | 1 | 5 |
| 312 | I-26 | $3 \times 10^{-4}$ | " | " | 115 | >20 | >6.0 | 110 | 18.8 | 5.8 | 4.5 | 5 |
| 313 | " | $6 \times 10^{-4}$ | " | " | 115 | >18.6 | >6.0 | 107 | 17.2 | 5.7 | 5 | 4.5 |
| 314 | — | — | Comparative Compound c | " | 85 | 14 | 5.6 | 72 | 10 | 5.0 | 2 | 5 |
| 315 | I-26 | $3 \times 10^{-4}$ | Comparative Compound c | $5 \times 10^{-4}$ | 80 | 12 | 5.4 | 71 | 9 | 4.8 | 3.5 | 5 |
| 316 | " | $6 \times 10^{-4}$ | Comparative Compound c | " | 78 | 10 | 5.3 | 63 | 8.8 | 4.7 | 4.5 | 4 |
| 317 | — | — | Comparative Compound d | " | 80 | 13.6 | 5.4 | 67 | 10.3 | 4.9 | 2 | 5 |
| 318 | I-26 | $3 \times 10^{-4}$ | Comparative Compound d | " | 78 | 11.2 | 5.2 | 63 | 9.8 | 4.7 | 4 | 5 |
| 319 | " | $6 \times 10^{-4}$ | Comparative Compound d | " | 75 | 9.6 | 5.0 | 61 | 8.0 | 4.6 | 4.5 | 4 |

Note:
Comparative Compound c:

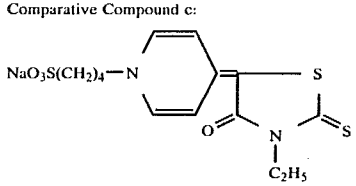

Comparative Compound d:

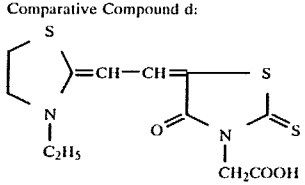

It can be seen from Table 2 that Samples 309, 310, 312, and 313 according to the present invention provided a high level of maximum density, which was fairly maintained even when processed with a developer used for processing a large volume of films. These samples also provided free from black pepper even when processed under conditions of increased pH and decreased sulfite ion concentration. To the contrary, the comparative samples containing Comparative Compound c or d having a rhodanine ring had low sensitivities and low gammas.

EXAMPLE 4

To a gelatin aqueous solution kept at 50° C. were added simultaneously an aqueous solution of silver nitrate and an aqueous solution of potassium iodide and potassium bromide over a period of 60 minutes in the presence of $4\times10^{-7}$ mol/mol-Ag of potassium hexachloroiridate (III) and ammonia. During the addition, the pAg of the system was maintained at 7.8. There was obtained a mono-disperse emulsion of cubic silver iodobromide having a mean grain size of 0.28 μm and an average silver iodide content of 0.3 mol %. After desalting by a flocculation method, 40 g/mol-Ag of inert gelatin was added to the emulsion. To the emulsion maintained at 50° C. were further added 5,5'-dichloro-9-ethyl-3,3'-bis(3-sulfopropyl)oxacarbocyanine (Comparative Compound a) and $10^{-3}$ mol/mol-Ag of a potassium iodide aqueous solution. The emulsion was left to stand at that temperature for 15 minutes and then allowed to cool. The emulsion was again heated at 40° C., and the compounds of formulae (III) and (I), the amounts and kinds thereof being shown in Table 3, $1.2\times10^{-3}$ mol/mol-Ag of Compound (IV-5) and $0.5\times10^{-4}$ mol/mol-Ag of Compound (IV-14) were added thereto at the temperature. Further, 5-methylbenzotriazole, 4-hydroxy-1,3,3a,7-tetraazaindene, compounds of formulae (4) and (5) shown below, a polyethyl acrylate dispersion (particle size), and, as a gelatin hardening agent, Compound (V-6) were added to the emulsion. The resulting coating composition was coated on a polyethylene terephthalate film to a silver coverage of 3.4 g/m$^2$. On the emulsion layer was simultaneously coated a protective layer comprising 1.5 g/m$^2$ of gelatin, 50 mg/m$^2$ of polymethyl methacrylate particles having a particle diameter of 2.5 μm, 0.15 g/m$^2$ of methanol silica, and, as coating aids, a fluorine-containing surface active agent of formula (2) shown above and sodium dodecylbenzenesulfonate.

Each of the resulting samples was evaluated for photographic characteristics according to the following test methods, and the results obtained are shown in Table 3.

(1) Relative Sensitivity:

The sample was exposed to light through a step wedge having an optical density difference of 0.1 and developed with a developer ("GRD$_1$" for a "GRANDEX" system produced by Fuji Photo Film) at 34° C. for 30 seconds. The sensitivity was evaluated by determining the the reciprocal of an exposure, and the result was relatively expressed taking the sensitivity of Sample 401 as a standard (100). The higher the value, the higher the sensitivity.

(2) Gamma:

A gradient between optical densities of 0.1 and 3.5 was measured.

(3) Practical Maximum Density ($D_{max}$):

A Chinese character "±" (Ming-style type, 7 point) was printed on a paper for manual photo-composing ("PL-100 WP" was produced by Fuji Photo Film). The printed image was scanned across the longer lateral stroke of "±" by means of microdensitometer, and the solid area having a reflection density of 0.8 was confirmed to have a line thickness of 40 μm. This image was photographed on the sample with a reflex process camera ("DSC-351" manufactured by Dai-Nippon Screen Co., Ltd.). The sample was developed, fixed and washed according to the procedure described in Example. The same area of the resulting negative image (whitened area) was scanned with a microdensitometer in the same manner as described above. When the whitened area having a transmission density of 0.8 had a line thickness of 40 μm, the exposure condition was designated as a 1:1 reproduction condition. Under such a 1:1 reproduction condition, the transmission density of the solid area of the negative image which corresponded to the white background of the original was measured by a Macbeth densitometer ("TD-504") to obtain a practical $D_{max}$. In general, the lower practical $D_{max}$ acceptable for practical use is 3.5 and preferably 4.5 or more.

(4) Black Pepper Inhibition:

The sample was exposed and developed in the same manner as described in (1) above, except that the pH of the developer was raised by 0.1 with a 10% aqueous solution of potassium hydroxide. The thus processed sample was visually observed under a 25× magnifier, and the degree of black pepper inhibition was evaluated in five grades (Grade 5 . . . no black pepper observed; Grade 3 . . . limit for practical use; Grades 2 and 1 . . . impractical).

(5) Color Remaining:

The sample was separately developed at 38° C. for 20 seconds, and the hue of the unexposed area was visually observed and evaluated in five grades (Grade 5 . . . the best; Grade 1 . . . the worst).

(6) Pressure Properties:

A diamond stylus of 10 μm in diameter was moved in contact with the emulsion layer of the sample under a load of 10 g. The sample was developed in the same manner as described in (1) above. The pressure marks of the developed sample were visually observed and evaluated according to the following rating system, taking the degree of occurrence, thickeness, and density of the linear fog into consideration.

5 . . . No occurrence
4 . . . Slightly perceivable
3 . . . Limit for practical use
2 . . . Impractical
1 . . . Impractical (conspicuously thick).

(7) Anti-adhesion Properties:

Each sample was cut to a size of 4 cm×4 cm, and a set of two cut films was allowed to stand at 35° C. and 80% RH for 24 hours. Then, the two films were brought into contact with each other with the backing of one of them facing the light-insensitive uppermost layer of the other, and the set was allowed to stand at 35° C. and 80% RH for 24 hours with a load of 1 kg applied thereon. The load was removed, the backing layer and the light-insensitive layer were peeled apart. Anti-adhesion properties were evaluated by measuring the ratio of the area of the adhesion portion, i.e., the portion of the light-insensitive layer which was colored with a dye transferred from the backing layer, to the whole area. The result was graded according to the following rating system:

5 . . . Up to 20%
4 . . . Between 21% and 40%
3 . . . Between 41% and 60%
2 . . . Between 61% and 80%
1 . . . 81% or more.

TABLE 3

| Sample No. | Compound of Formula (III) | | Compound of Formula (I) | | Photographic Characteristics | | | | | | |
|---|---|---|---|---|---|---|---|---|---|---|---|
| | Compound No. | Amount Added (mol/mol-Ag) | Compound No. | Amount Added (mol/mol-Ag) | Relative Sensitivity | Gamma | Practical $D_{max}$ | Black Pepper | Color Remaining | Pressure Properties | Anti-Blocking Properties |
| 401 | — | — | — | — | 100 | 16 | 4.8 | 2 | 5 | 1 | 5 |
| 402 | Comparative Compound f | 0.01 | — | — | 98 | 14 | 4.7 | " | " | 2 | 4 |
| 403 | Comparative Compound f | 0.05 | — | — | 93 | 13 | 4.4 | " | " | 4 | 2 |
| 404 | Comparative Compound f | 0.10 | — | — | 72 | 11 | 4.1 | 3 | " | 4.5 | 1 |
| 405 | — | — | I-26 | $2 \times 10^{-4}$ | 102 | 19 | 5.2 | 3.5 | " | 1 | 5 |
| 406 | — | — | " | $4 \times 10^{-4}$ | 105 | 17 | 5.6 | 4.5 | " | " | " |
| 407 | Comparative Compound f | 0.05 | " | " | 100 | 16 | 5.4 | 4.5 | " | 4 | 2 |
| 408 | Comparative Compound f | 0.10 | " | " | 95 | 15 | 5.1 | 4.5 | " | 5 | 1 |
| 409 | III-2 | 0.01 | " | " | 102 | 16.5 | 5.4 | 4.5 | " | 4 | 5 |
| 410 | " | 0.02 | " | " | 100 | 16 | 5.3 | " | " | 4.5 | 4.5 |
| 411 | " | 0.05 | " | " | 93 | 14 | 4.7 | 5 | " | 5 | 4 |
| 412 | III-41 | 0.01 | " | " | 102 | 16 | 5.5 | 4.5 | " | 4 | 5 |
| 413 | " | 0.02 | " | " | 100 | 15.5 | 5.2 | 5 | " | 4.5 | 4.5 |
| 414 | III-41 | 0.05 | I-26 | $4 \times 10^{-4}$ | 95 | 14.5 | 4.8 | 5 | 5 | 5 | 4 |
| 415 | — | — | I-2 | " | 108 | 16 | 5.0 | 4.5 | " | 1 | 5 |
| 416 | III-10 | 0.02 | " | " | 102 | 14.5 | 4.8 | " | " | 4.5 | 4.5 |
| 417 | " | " | Comparative Compound e | $2 \times 10^{-4}$ | 108 | 16 | 5.2 | 4.5 | 1.5 | 4 | 4.5 |
| 418 | " | " | Comparative Compound e | $4 \times 10^{-4}$ | 98 | 16.5 | 5.3 | 5 | 1 | 4 | 4.5 |
| 419 | III-2 | " | Comparative Compound c | $2 \times 10^{-4}$ | 100 | 14 | 4.7 | 2 | 2 | 4 | 4.5 |
| 420 | " | " | Comparative Compound c | $4 \times 10^{-4}$ | 93 | 12 | 4.3 | " | 1.5 | 4 | 4.5 |

Note:
Comparative Compound e:

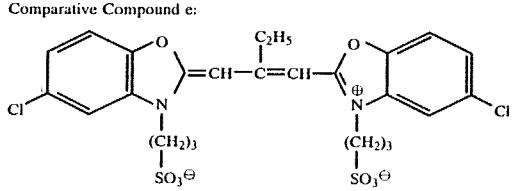

Comparative Compound f:

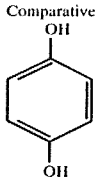

It can be seen from Table 3 that the construction of the present invention achieved satisfactory levels in all the test performances.

EXAMPLE 5

A mono-disperse emulsion of cubic silver chloroiodobromide emulsion having a grain size of 0.2 μm (coefficient of variation: 0.10; silver iodide content: 0.1 mol %; silver bromide content: 30 mol %) was prepared according to a controlled double jet process. To the (emulsion were added $1\times10^{-6}$ mol/mol-Ag of $(NH_4)_3RhCl_5$ and $4\times10^{-7}$ mol/mol-Ag of $K_3IrCl_6$. After desalting, the emulsion was subjected to gold-sulfur sensitization. To the emulsion while being kept at 50° C. were added a sensitizing dye and a potassium iodide solution in the same manner as in Example 4. After reheating, the same other additives as used in Example 4 were added to the emulsion, except for replacing the gelatin hardening agent (V-6) with Compound (V-4) and changing the compounds of formulae (III) and (I) as indicated in Table 4. The resulting coating composition was coated on a polyethylene terephthalate film together with a protective film in the same manner as in Example 4.

Each of the resulting samples was processed and evaluated in the same manner as in Example 4. The results obtained are shown in Table 4.

As can be seen from Table 4, the present invention was excellent in all the requirements tested.

TABLE 4

| Sample No. | Compound of Formula (III) | | Compound of formula (I) | | Photographic Characteristics | | | | | | Anti-Blocking Properties |
|---|---|---|---|---|---|---|---|---|---|---|---|
| | Compound No. | Amount Added (mol/mol-Ag) | Compound No. | Amount Added (mol/mol-Ag) | Relative Sensitivity | Gamma | Practical $D_{max}$ | Black Pepper | Color Remaining | Pressure Properties | |
| 501 | — | — | — | — | 100 | 18 | 5.4 | 1 | 5 | 1 | 5 |
| 502 | Comparative Compound f | 0.01 | — | — | 100 | 17 | 5.3 | " | " | 2 | 3.5 |
| 503 | Comparative Compound f | 0.05 | — | — | 96 | 16 | 5.0 | " | " | 4 | 1 |
| 504 | Comparative Compound f | 0.10 | — | — | 90 | 15.5 | 4.7 | 1.5 | " | 4.5 | " |
| 505 | — | — | I-16 | $2 \times 10^{-4}$ | 110 | 21 | 5.8 | 3 | " | 1 | 5 |
| 506 | — | — | " | $4 \times 10^{-4}$ | 104 | 19 | 6.0 | 4 | " | " | " |
| 507 | Comparative Compound f | 0.05 | " | " | 100 | 18 | 5.7 | 4 | " | 4.5 | 1 |
| 508 | Comparative Compound f | 0.10 | " | " | 94 | 16 | 5.4 | 4.5 | " | 5 | " |
| 509 | III-10 | 0.01 | " | " | 104 | 19 | 6.0 | " | " | 4 | 5 |
| 510 | " | 0.02 | " | " | 100 | 17 | 5.9 | " | " | 4.5 | 4.5 |
| 511 | " | 0.05 | " | " | 97 | 16.5 | 5.6 | 5 | " | 5 | 4 |
| 512 | III-16 | 0.01 | " | " | 102 | 18 | 5.9 | 4.5 | " | 3.5 | 5 |
| 513 | " | 0.02 | " | " | 100 | 17.5 | 5.8 | " | " | 4 | 4.5 |
| 514 | " | 0.05 | I-16 | $4 \times 10^{-4}$ | 95 | 16 | 5.5 | 5 | " | 4.5 | 4 |
| 515 | — | — | I-26 | " | 110 | 20 | 6.0 | 4 | " | 1 | 5 |
| 516 | III-36 | 0.02 | " | " | 102 | 17 | 5.7 | 4.5 | " | 4.5 | 4.5 |
| 517 | " | " | Comparative Compound e | $2 \times 10^{-4}$ | 110 | 21 | 6.0 | " | 2 | 4 | 4.5 |
| 518 | " | " | Comparative Compound e | $4 \times 10^{-4}$ | 105 | 21 | 5.9 | " | 1 | " | " |
| 519 | III-16 | " | Comparative Compound c | $2 \times 10^{-4}$ | 98 | 17 | 5.6 | 3 | 2.5 | " | " |
| 520 | " | " | Comparative Compound c | $4 \times 10^{-4}$ | 90 | 15 | 5.1 | 2.5 | 2 | " | " |

EXAMPLE 6

Sample 409 of Example 4 was developed with a developer having the following formulation and evaluated for photographic performances in the same manner as in Example 4. The results obtained were similarly satisfactory.

| Developer Formulation: | |
|---|---|
| Hydroquinone | 50.0 g |
| N-Methyl-p-amionphenol hemisulfate | 0.3 g |
| Sodium hydroxide | 18.0 g |
| Potassium secondary phosphate | 38.0 g |
| Potassium sulfite | 110.0 g |
| Disodium ethylenediaminetetraacetate | 1.0 g |
| Potassium bromide | 10.0 g |
| 5-Methylbenzotriazole | 0.4 g |
| 2-Mercaptobenzimidazole-5-sulfonic acid | 0.3 g |
| Sodium 3-(5-Mercaptotetrazole)-benezenesulfonate | 0.2 g |
| N-n-Butyldiethanolamine | 15.0 g |
| Sodium toluenesulfonate | 8.0 g |
| Water to make | 1 l |
| (pH = 11.6 adjusted with potassium hydroxide) | |

While the invention has been described in detail and with reference to specific embodiments thereof, it will be apparent to one skilled in the art that various changes and modifications can be made therein without departing from the spirit and scope thereof.

What is claimed is:

1. A silver halide negative photographic material comprising a support having thereon at least one silver halide emulsion layer, at least one hydrophilic colloidal layer thereof comprising:

(1) a hydrazine derivative;

(2) a compound having no substantial absorption maximum in the visible light region represented by formula (I):

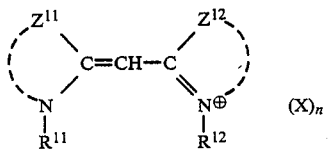

(I)

wherein $Z^{11}$ and $Z^{12}$, which may be the same or different, each represents a non-metallic atomic group necessary for forming a substituted or unsubstituted heterocyclic ring selected from benzoxazole, benzothiazole, benzoselenazole, naphthoxazole, naphthothiazole, naphthoselenazole, thiazole, thiazoline, oxazole, selenazole, selenazoline, pyridine, benzimidazole and quinoline; $R^{11}$ and $R^{12}$, which may be the same or different, each represents a substituted or unsubstituted alkyl group or a substituted or unsubstituted aralkyl group, provided that at least one of $R^{11}$ and $R^{12}$ is substituted with an acid group; X represents a counter ion necessary for charge balance; and n is 0 or 1; and (3) at least one compound represented by formula (II) or (III):

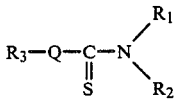

(II)

wherein $R_1$ and $R_2$, which may be the same or different, each represents hydrogen, a substituted or unsubstituted alkyl group, a substituted or unsubstituted aryl group, a substituted or unsubstituted heterocyclic group or an amino group; $R_3$ represents hydrogen, a substituted or unsubstituted alkyl group, a substituted or unsubstituted aryl group or a substituted or unsubstituted heterocyclic group; and Q represents a single bond or a divalent group selected from sulfur, selenium, oxygen, a disulfide group,

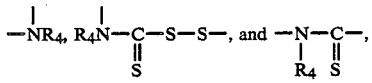

wherein $R_4$ has the same definition as $R_3$; provided that $R_1$ and $R_2$, $R_1$ and $R_3$, or $R_3$ and $R_4$ may be linked to form a substituted or unsubstituted 5-membered or 6-membered heterocyclic ring; further provided at least one of $R_2$ and $R_4$ represents a group other than hydrogen when $R_1$ and $R_3$ are linked to form a heterocyclic ring, and said heterocyclic ring formed by $R_1$ and $R_3$ is a ring other than a rhodanine ring; and

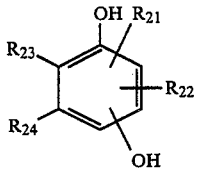

(III)

wherein $R_{21}$, $R_{22}$, $R_{23}$, and $R_{24}$, which may be the same or different, each represents hydrogen, a hydroxyl group, an alkoxy group, an aryloxy group, an alkylthio group, an arylthio group, a halogen atom, a primary amino group, a secondary amino group, a tertiary amino group, a carbonamido group, a sulfonamido group, an alkyl group, an aryl group, a 5-membered or 6-membered heterocyclic group containing at least one hetero atom selected from nitrogen, oxygen and sulfur, a formyl group, a keto group, a sulfo group, a carboxyl group, an alkylsulfonyl group or an arylsulfonyl group; provided that at least one of $R_{21}$, $R_{22}$, $R_{23}$, and $R_{24}$ represents a group other than hydrogen when the compound represented by formula (III) is 1,4-dihydroxybenzene, said at least one compound of the formula (II) and the formula (III) being incorporated in said layer containing said hydrazine compound.

2. The silver halide negative photographic material as claimed in claim 1, wherein in formula (I) said heterocyclic ring formed by $Z^{11}$ and $Z^{12}$ is selected from benzoxazole, benzothiazole, naphthoxazole, naphthothiazole and oxazole.

3. The silver halide negative photographic material as claimed in claim 2, wherein said heterocyclic ring formed by $Z^{11}$ and $Z^{12}$ is selected from benzoxazole, benzothiazole and naphthoxazole.

4. The silver halide negative photographic material as claimed in claim 3, wherein said heterocyclic ring formed by $Z^{11}$ and $Z^{12}$ is selected from benzoxazole and naphthoxazole.

5. The silver halide negative photographic material as claimed in claim 1, wherein said substituted heterocyclic ring formed by $Z^{11}$ and $Z^{12}$ is substituted with a substituent selected from a halogen atom, a nitro group, an alkyl group containing at more 4 carbon atoms, an aryl group, an alkoxy group containing at most 4 carbon atoms, a carboxyl group, an alkoxycarbonyl group containing from 2 to 5 carbon atoms, a hydroxyl group and a cyano group.

6. The silver halide negative photographic material as claimed in claim 1, wherein in formula (I) $R_{11}$ and $R_{12}$ each represents an unsubstituted alkyl group containing at most 18 carbon atoms or an alkyl group containing at most 6 carbon atoms substituted with a substituent selected from a sulfo group, a sulfoalkoxy group, a sulfoaryl group, a carboxyl group, a carboxyalkoxy group, a carboxyaryl group, a hydroxyalkyl group, an alkoxyalkyl group, an alkoxycarbonylalkyl group, a vinyl-substituted alkyl group, a cyanoalkyl group, a carbamoylalkyl group, an aryloxyalkyl group, an aralkyl group.

7. The silver halide negative photographic material as claimed in claim 1, wherein said acid group substituent for $R_{11}$ and $R_{12}$ is selected from a sulfo group and a carboxyl group.

8. The silver halide negative photographic material as claimed in claim 1, wherein formula (II) said alkyl group represented by $R_1$, $R_2$, $R_3$ and $R_4$ contains from 1 to 20 carbon atoms; said aryl group represented by $R_1$, $R_2$, $R_3$, and $R_4$ is a substituted or unsubstituted monocyclic group; and said heterocyclic group represented by $R_1$, $R_2$, $R_3$ and $R_4$ is a 5-membered to 7-membered heterocyclic group.

9. The silver halide negative photographic material as claimed in claim 8, wherein said heterocyclic ring formed by $R_1$ and $R_2$, and said heterocyclic ring formed by $R_3$ and $R_4$, each is selected from piperidine, piperazine, morpholine, pyrrole, pyrazole, imidazole and triazole; and said heterocyclic ring formed by $R_1$ and $R_3$ is selected from thiazoline, thiazolidine, selenazoline, oxazoline, oxazolidine, imidazoline, imidazolidine, pyrazoline, pyrazolidine, 1,3,4-thiadiazoline, 1,3,4-oxadiazoline, 1,3,4-triazoline, tetrazoline, thiohydantoin, dihydropyridine, dihydropyrimidine, and dihydrotriazine.

10. The silver halide negative photographic material as claimed in claim 9, wherein each said heterocyclic ring formed by $R_1$ and $R_3$ is condensed with a 5-membered to 7-membered carbocyclic ring or a 5-membered to 7-membered heterocyclic group.

11. The silver halide negative photographic material as claimed in claim 9, wherein said heterocyclic ring formed by $R_1$ and $R_2$, and said heterocyclic ring formed by $R_3$ and $R_4$, each is selected from piperidine, pyrrole, piperazine, and morpholine.

12. The silver halide negative photographic material as claimed in claim 1, wherein said compound represented by formula (II) is represented by formula (IIa):

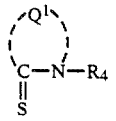

(IIa)

wherein R4 represents a substituted or unsubstituted alkyl group, a substituted or unsubstituted aryl group or a substituted or unsubstituted heterocyclic group; and $Q^1$ represents an atomic group necessary for forming a 5-membered or 6-membered heterocyclic ring, provided that the atom of said atomic group adjacent to the thioketo group in formula (IIa) is not bonded to hydrogen.

13. The silver halide negative photographic material as claimed in claim 12, wherein said atom in said atomic group $Q^1$ is adjacent to said thioketo group is selected from sulfur, oxygen and nitrogen.

14. The silver halide negative photographic material as claimed in claim 12, wherein said heterocyclic ring formed by $Q^1$ is selected from thiazoline, thiazolidine, selenazoline, oxazoline, oxazolidine, imidazoline, imidazolidine, pyrazoline, pyrazolidine, 1,3,4-thiadiazoline, 1,3,4-oxadiazoline, 1,3,4-triazoline, tetrazoline, thiohydantoin, dihydropyridine, dihydropyrimidine, and dihydrotriazine.

15. The silver halide negative photographic material as claimed in claim 1, wherein said hydrazine derivative is represented by formula (IV):

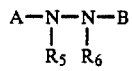

(IV)

wherein A represents an aliphatic group or an aromatic group; B represents a formyl group, an acyl group, an alkylsulfonyl group, an arylsulfonyl group, an alkylsufinyl group, an arylsufinyl group, a carbamoyl group, an alkoxycarbonyl group, an aryloxycarbonyl group, a sulfinamoyl group, an alkoxysulfonyl group, a thioacyl group, a thiocarbamoyl group, a sulfamoyl group, or a heterocylic group; and $R_5$ and $R_6$, which may be the same or differnt each represents hydrogen, a substituted or unsubstituted alkylsulfonyl group, a substituted or unsubstituted arylsulfonyl group, or a substituted or unsubstituted acyl group; provided that at least one of $R_5$ and $R_6$ represents hydrogen and B, $R_6$ and said nitrogen atom to which both are linked to form

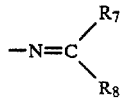

wherein $R_7$ represents an alkyl group, an aryl group or a heterocyclic group; and $R_8$ represents hydrogen, an alkyl group, an aryl group or a heterocyclic group.

16. The silver halide negative photographic material as claimed in claim 15, wherein A represents an aryl group; B represents a formyl group or an acyl group; and $R_5$ and $R_6$ each represents hydrogen.

17. The silver halide negative photographic material as claimed in claim 1, wherein said hydrazine derivative, said compound represented by formula (I) and said at least one compound represented by formula (II) or (III) are each present in said silver halide emulsion layer.

18. The silver halide negative photographic material as claimed in claim 1, wherein said compound represented by formula (I) is present in an amount of from $1\times10^{-6}$ to $1\times10^{-2}$ mol per mol of silver halide in said silver halide emulsion layer; said compound represented by formula (II) is present in an amount of from $1\times10^{-6}$ to $5\times10^{-2}$ mol per mol of silver halide in said silver halide emulsion layer; said compound represented by formula (III) is present in an amount of from $1\times10^{-6}$ to $1\times10^{-1}$ mol per mol of silver halide in said silver halide emulsion layer; and said hydrazine derivative is present in an amount of from $1\times10^{-6}$ to $1\times10^{-1}$ mol per mol of silver halide in said silver halide emulsion layer.

19. The silver halide negative photographic material as claimed in claim 1, wherein said compound represented by formula (I) is present in an amount of from $1\times10^{-5}$ to $5\times10^{-3}$ mol per mol of silver halide in said silver halide emulsion layer; said compound represented by formula (II) is present in an amount of from $3\times10^{-5}$ to $1\times10^{-2}$ mol per mol of silver halide in said silver halide emulsion layer; said compound represented by formula (III) is present in an amount of from $5\times10^{-3}$ to $7.5\times10^{-2}$ mol per mol of silver halide in said silver halide emulsion layer; and said hydrazine derivative is present in an amount of from $1\times10^{-5}$ to $4\times10^{-3}$ mol per mol of silver halide in said silver halide emulsion layer.

20. A method for forming an image comprising the steps of:

(a) imagewise exposing a silver halide negative photographic material comprising a support having thereon at least one silver halide emulsion layer, at least one hydrophilic colloidal layer thereof comprising:

(1) a hydrazine derivative;

(2) a compound substantially having no absorption maximum in the visible light region represented by formula (I):

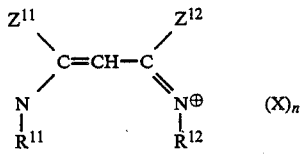

(I)

wherein $Z^{11}$ and $Z^{12}$, which may be the same or different, each represents a non-metallic atomic group necessary for forming a substituted or unsubstituted heterocyclic ring selected from benzoxazole, benzothiazole, benzoselenazole, naphthoxazole, naphthothiazole, naphthoselenazole, thiazole, thiazoline, oxazole, selenazole, selenazoline, pyridine, benzimidazole and quinoline; $R^{11}$ and $R^{12}$, which may be the same or different, each represents a substituted or unsubstituted alkyl group or a substituted or unsubstituted aralkyl group, provided that at least one of $R^{11}$ and $R^{12}$ is substituted with an acid group; X represents a counter ion necessary for charge balance; and n is 0 or 1; and (3) at least one compound represented by formula (II) or (III):

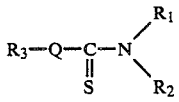

(II)

wherein $R_1$ and $R_2$, which may be the same or different, each represents hydrogen, a substituted or unsubstituted alkyl group, a substituted or unsubstituted aryl group, a substituted or unsubstituted heterocyclic group or an amino group; $R_3$ represents hydrogen, a substituted or unsubstituted alkyl group, a substituted or unsubstituted aryl group or a substituted or unsubstituted heterocyclic group; and Q represents a single bond or a divalent group selected from sulfur, selenium, oxygen, a disulfide group,

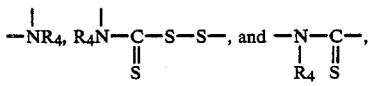

wherein $R_4$ has the same meaning as $R_3$; provided that $R_1$ and $R_2$, $R_1$ and $R_3$, or $R_3$ and $R_4$ may be linked to form a substituted or unsubstituted 5-membered or 6-membered heterocyclic ring; further provided at least one of $R_2$ and $R_4$ represents a group other than hydrogen when $R_1$ and $R_3$ are linked to form a heterocyclic ring, and said heterocyclic ring formed by $R_1$ and $R_3$ is a ring other than a rhodanine ring, and

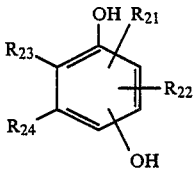

(III)

wherein $R_{21}$, $R_{22}$, $R_{23}$, and $R_{24}$, which may be the same or different, each represents hydrogen, a hydroxyl group, an alkoxy group, an aryloxy group, an alkylthio group, an arylthio group, a halogen atom, a primary amino group, a secondary amino group, a tertiary amino group, a carbonamido group, a sulfonamido group, an alkyl group, an aryl group, a 5-membered or 6-membered heterocyclic group containing at least one hetero atom selected from nitrogen, oxygen and sulfur, a formyl group, a keto group, a sulfo group, a carboxyl group, an alkylsulfonyl group or an arylsulfonyl group; provided that at least one of $R_{21}$, $R_{22}$, $R_{23}$, and $R_{24}$ represents a group other than hydrogen when the compound represented by formula (III) is 1,4-dihydroxybenzene, said at least one compound of the formula (II) and the formula (III) being incorporated in said layer containing said hydrazine compound; and (b) developing said exposed material with a developer solution having a pH of from 10.5 to 12.3 and containing a sulfite ion concentration of at least 0.15 mol/liter, to form a negative image.

* * * * *